US009945073B2

(12) United States Patent
Amidon et al.

(10) Patent No.: US 9,945,073 B2
(45) **Date of Patent: *Apr. 17, 2018**

(54) METHODS OF PRODUCING A PAPER PRODUCT

(71) Applicant: The Research Foundation for The State University of New York, Albany, NY (US)

(72) Inventors: Thomas E. Amidon, Jamesville, NY (US); Raymond Francis, Syracuse, NY (US); Gary M. Scott, Syracuse, NY (US); Jeremy Bartholomew, Plattsburgh, NY (US); Bandaru V. Ramarao, Fayetteville, NY (US); Christopher D. Wood, Syracuse, NY (US)

(73) Assignee: The Research Foundation for The State University of New York, Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/625,545

(22) Filed: Jun. 16, 2017

(65) Prior Publication Data

US 2017/0306557 A1 Oct. 26, 2017

Related U.S. Application Data

(60) Continuation of application No. 15/051,742, filed on Feb. 24, 2016, now Pat. No. 9,683,329, which is a (Continued)

(51) Int. Cl.
*D21C 1/02* (2006.01)
*D21C 3/00* (2006.01)

(Continued)

(52) U.S. Cl.
CPC ..... *D21C 3/04* (2013.01); *D21C 1/02* (2013.01); *D21C 3/00* (2013.01); *D21C 3/02* (2013.01);

(Continued)

(58) Field of Classification Search
CPC . D21C 5/005; D21C 1/00; D21C 1/02; D21C 11/0007; D21C 3/222; D21C 9/10;

(Continued)

(56) References Cited

U.S. PATENT DOCUMENTS 2,701,763 A 2/1955 Sivola
3,046,182 A 7/1962 Tomlinson et al.

(Continued)

FOREIGN PATENT DOCUMENTS

CN 1340121 A 3/2002
EP 0 095 239 A1 11/1983

(Continued)

OTHER PUBLICATIONS

Sven A. Rydholm, Pulping Processes, 1965, Interscience Publisher, pp. 663-671.*

(Continued)

*Primary Examiner* — Jose A Fortuna
(74) *Attorney, Agent, or Firm* — Scully, Scott, Murphy & Presser, P.C.

(57) ABSTRACT

An omnibus process of pulping and bleaching lignocellulosic materials in which a charge of a lignocellulosic material is biopulped and/or water extracted prior to pulping and bleaching. The lignocellulosic material may be mechanically pulped and bleached in the presence of an enzyme that breaks lignin-carbohydrate complexes.

5 Claims, 10 Drawing Sheets

Related U.S. Application Data continuation of application No. 14/603,663, filed on Jan. 23, 2015, now Pat. No. 9,273,431, which is a continuation of application No. 14/198,754, filed on Mar. 6, 2014, now Pat. No. 8,940,133, which is a continuation of application No. 13/683,642, filed on Nov. 21, 2012, now Pat. No. 8,668,806, which is a division of application No. 11/412,593, filed on Apr. 27, 2006, now Pat. No. 8,317,975, which is a continuation-in-part of application No. PCT/US2005/013216, filed on Apr. 20, 2005.

(60) Provisional application No. 60/563,837, filed on Apr. 20, 2004, provisional application No. 60/679,151, filed on May 9, 2005.

(51) Int. Cl.

| | |
|---|---|
| ***D21C 3/02*** | (2006.01) |
| ***D21C 3/22*** | (2006.01) |
| ***D21H 11/02*** | (2006.01) |
| ***D21C 3/04*** | (2006.01) |
| ***D21C 5/00*** | (2006.01) |
| ***D21C 9/16*** | (2006.01) |
| ***D21C 11/00*** | (2006.01) |
| ***D21H 11/08*** | (2006.01) |
| ***D21H 11/10*** | (2006.01) |
| ***D21H 17/00*** | (2006.01) |
| ***D21H 21/32*** | (2006.01) |
| ***D21C 9/10*** | (2006.01) |
| ***D21C 9/12*** | (2006.01) |
| ***D21C 9/147*** | (2006.01) |

(52) U.S. Cl.

CPC ..... *D21C 3/222* (2013.01); *D21C 5/005* (2013.01); *D21C 9/1063* (2013.01); *D21C 9/123* (2013.01); *D21C 9/147* (2013.01); *D21C 9/163* (2013.01); *D21C 11/0007* (2013.01); *D21H 11/02* (2013.01); *D21H 11/08* (2013.01); *D21H 11/10* (2013.01); *D21H 17/005* (2013.01); *D21H 21/32* (2013.01); *D21C 9/1057* (2013.01)

(58) Field of Classification Search

CPC ..... D21C 9/1036; D21C 3/02; D21C 9/163; D21C 9/1057; D21H 7/005; D21H 11/02; D21H 11/08; D21H 11/10; D21H 21/32; Y10S 162/12; D21B 1/00

USPC .... 162/14, 17, 19, 24, 26, 29, 30.11, 41–43, 162/47, 52, 55, 63–67, 70, 72, 78, 82, 87

See application file for complete search history.

(56) References Cited

U.S. PATENT DOCUMENTS

| | | | | |
|---|---|---|---|---|
| 3,294,623 | A | 12/1966 | Brinkley, Jr. et al. | |
| 3,347,739 | A | 10/1967 | Tomlinson, II | |
| 3,380,883 | A | 4/1968 | Richter et al. | |
| 3,413,189 | A | 11/1968 | Backlund | |
| 3,585,104 | A | 6/1971 | Kleinert | |
| 3,632,469 | A | 1/1972 | Wilder | |
| 3,830,688 | A | 8/1974 | Mannbro | |
| 3,923,591 | A | 12/1975 | Villavicencio | |
| 4,016,029 | A | 4/1977 | Samuelson | |
| 4,071,399 | A | 1/1978 | Prough | |
| 4,174,997 | A | 11/1979 | Richter | |
| 4,436,586 | A | 3/1984 | Elmore | |
| 4,612,286 | A | 9/1986 | Sherman et al. | |
| 4,652,341 | A | 3/1987 | Prior | |
| 4,668,340 | A | 5/1987 | Sherman | |
| 4,706,903 | A | 11/1987 | Brink et al. | |
| 4,755,225 | A | 7/1988 | Pruitt | |
| 4,908,098 | A | 3/1990 | DeLong et al. | |
| 5,055,159 | A | 10/1991 | Blanchette et al. | |
| 5,221,357 | A | 6/1993 | Brink | |
| 5,338,366 | A | 8/1994 | Grace et al. | |
| 5,424,417 | A | 6/1995 | Torget et al. | |
| 5,486,068 | A | 1/1996 | Wilson | |
| 5,503,709 | A | 4/1996 | Burton | |
| 5,536,325 | A | 7/1996 | Brink | |
| 5,554,535 | A | 9/1996 | Blanchette et al. | |
| 5,589,033 | A | 12/1996 | Tikka et al. | |
| 5,620,564 | A | 4/1997 | Akhtar | |
| 5,628,830 | A | 5/1997 | Brink | |
| 5,676,795 | A | 10/1997 | Wizani et al. | |
| 5,750,005 | A | 5/1998 | Akhtar | |
| 5,879,510 | A | 3/1999 | Hagglund et al. | |
| 6,071,380 | A | 6/2000 | Hoffman | |
| 6,258,209 | B1 | 7/2001 | Stohrer et al. | |
| 6,402,887 | B1 | 6/2002 | Akhtar et al. | |
| 6,409,841 | B1 | 6/2002 | Lombard | |
| 6,509,180 | B1 | 1/2003 | Verser et al. | |
| 6,533,896 | B1 | 3/2003 | Tikka et al. | |
| 6,613,192 | B1 | 9/2003 | Bajpai et al. | |
| 6,770,168 | B1 | 8/2004 | Stigsson | |
| 6,776,876 | B1 | 8/2004 | Vuorinen et al. | |
| 7,008,505 | B2 | 3/2006 | Akhtar et al. | |
| 7,189,306 | B2 | 3/2007 | Gervais | |
| 7,294,228 | B2 | 11/2007 | Huang et al. | |
| 8,317,975 | B2 * | 11/2012 | Amidon | D21C 3/02 162/14 |
| 8,500,910 | B2 | 8/2013 | Brady et al. | |
| 8,618,280 | B2 * | 12/2013 | Howard | C08H 8/00 536/123.1 |
| 8,668,806 | B2 * | 3/2014 | Amidon | D21C 3/02 162/14 |
| 8,940,133 | B2 * | 1/2015 | Amidon | D21C 3/02 162/14 |
| 9,273,431 | B2 * | 3/2016 | Amidon | D21C 3/02 |
| 9,624,449 | B2 * | 4/2017 | Howard | C08H 8/00 |
| 9,683,329 | B2 * | 6/2017 | Amidon | D21C 3/04 |
| 2001/0018956 | A1 | 9/2001 | Stohrer et al. | |
| 2004/0016525 | A1 | 1/2004 | Gervais | |
| 2004/0026051 | A1 * | 2/2004 | Stromberg | D21C 9/1057 162/65 |
| 2004/0104003 | A1 | 6/2004 | Bajpai et al. | |
| 2004/0154762 | A1 | 8/2004 | Akhtar et al. | |
| 2004/0163780 | A1 | 8/2004 | Huang et al. | |
| 2004/0200589 | A1 * | 10/2004 | Herring | D21C 3/222 162/82 |
| 2006/0060316 | A1 | 3/2006 | Huang et al. | |
| 2006/0070710 | A1 * | 4/2006 | Hernesniemi | D21C 1/06 162/29 |
| 2007/0051481 | A1 | 3/2007 | Tan et al. | |
| 2007/0079944 | A1 | 4/2007 | Amidon et al. | |
| 2007/0193706 | A1 | 8/2007 | Kirov et al. | |
| 2008/0227161 | A1 | 9/2008 | Levie et al. | |
| 2008/0227182 | A1 | 9/2008 | Anderson et al. | |
| 2009/0194243 | A1 | 8/2009 | Akhtar et al. | |
| 2010/0243184 | A1 | 9/2010 | Vehmaa et al. | |
| 2010/0279361 | A1 | 11/2010 | South et al. | |
| 2012/0159840 | A1 | 6/2012 | Koskinen et al. | |
| 2012/0196233 | A1 | 8/2012 | Ni et al. | |
| 2013/0098569 | A1 | 4/2013 | Van Lee et al. | |
| 2013/0112359 | A1 | 5/2013 | Amidon et al. | |
| 2013/0143285 | A1 | 6/2013 | Tolan et al. | |
| 2014/0182796 | A1 | 7/2014 | Amidon et al. | |
| 2014/0326422 | A1 * | 11/2014 | Fallon | D21C 3/20 162/16 |
| 2015/0122429 | A1 * | 5/2015 | Dybov | D21C 3/00 162/14 |
| 2015/0129143 | A1 * | 5/2015 | Hawkins | D21C 3/02 162/72 |
| 2015/0136344 | A1 | 5/2015 | Amidon et al. | |
| 2015/0176207 | A1 | 6/2015 | Yin et al. | |
| 2015/0211184 | A1 * | 7/2015 | Hart | D21B 1/16 162/55 |

(56) References Cited

U.S. PATENT DOCUMENTS

| | | | | |
|---|---|---|---|---|
| 2016/0002359 | A1* | 1/2016 | Slupska | C12N 1/22 435/165 |
| 2016/0168791 | A1 | 6/2016 | Amidon et al. | |
| 2017/0159237 | A1* | 6/2017 | Buschmann | D21C 9/166 |
| 2017/0306557 | A1* | 10/2017 | Amidon | D21C 5/005 |

FOREIGN PATENT DOCUMENTS

| | | | |
|---|---|---|---|
| EP | 0 433 258 | A1 | 6/1991 |
| WO | 0041812 | | 8/2000 |
| WO | 03046227 | A1 | 6/2003 |
| WO | 2005103370 | A1 | 11/2005 |
| WO | 2006121634 | A2 | 11/2006 |
| WO | 2013028955 | A1 | 2/2013 |

OTHER PUBLICATIONS

Conner et al., "Kinetic Modelling of Hardwood Prehydrolysis. Part III. Water and Dilute Acetic Acid Prehydrolysis of Southern Red Oak", Wood and Fiber Science 18(2):248-263 (1986).

Garrote, G. et al., "Hydrothermal Processing of Lignocellulosic Materials", Holz als Roh-und Werkstoff 57:191-202 (1999).

Gullichsen et al., Chemical Pulping, Book 6A, Papermaking Science and Technology, Fapet Oy, 1999, pp. A411-A416, pp. A520-A521, and pp. A559.

Hanquan L., "Studies on Biological Pulping and Biological Bleaching Techniques in the Paper-Making Industry", Journal of Jiujiang Teacher's College, No. 6, pp. 20-24 (2003).

Kaye, A., "New Digester Additives Help to Optimize Kraft Pulp Mills", Nalco Company, pp. 1-2 (May 2004).

Parajó, J.C. et al., "Production of Xylooligo-saccharides by Autohydrolysis of Lignocellulosic Materials", Trends in Food Science & Technology 15:115-120 (2004).

Rydholm S.A., "Pulping Processes", Interscience Publishers, pp. 663-671 (1965).

Springer E.L., "Prehyrdolysis of Hardwoods with Dilute Sulfuric Acid", Ind. Eng. Chem. Prod. Res. Dev. 24:614-623 (1985).

Smook, Handbook for Pulp and Paper Technologists, Angus Wilde Publications Inc., 2nd edition, 1992, pp. 61 and 77.

Chinese Office Action dated Jan. 15, 2010 received from related Application No. 200680025049.6 together with an English-language translation.

U.S. Final Office Action dated Nov. 8, 2016 received in U.S. Appl. No. 15/051,742.

U.S. Office Action dated May 9, 2016 received in U.S. Appl. No. 15/051,742.

U.S. Office Action dated Apr. 9, 2014 received in U.S. Appl. No. 14/198,754.

U.S. Final Office Action dated Aug. 27, 2013 received in U.S. Appl. No. 13/683,642.

U.S. Office Action dated Mar. 15, 2013 received in U.S. Appl. No. 13/683,642.

U.S. Office Action dated Feb. 29, 2012 received in U.S. Appl. No. 11/412,593.

U.S. Final Office Action dated Sep. 21, 2011 received in U.S. Appl. No. 11/412,593.

U.S. Office Action dated Jan. 4, 2011 received in U.S. Appl. No. 11/412,593.

U.S. Final Office Action dated May 17, 2010 received in U.S. Appl. No. 11/412,593.

U.S. Office Action dated Aug. 11, 2009 received in U.S. Appl. No. 11/412,593.

* cited by examiner (i)

(ii)

(i)

(ii)

METHODS OF PRODUCING A PAPER PRODUCT

CROSS REFERENCE TO RELATED APPLICATIONS

This is a continuation of U.S. patent application Ser. No. 15/051,742, filed Feb. 24, 2016, now U.S. Pat. No. 9,683,329, which is a continuation of U.S. patent application Ser. No. 14/603,663, filed Jan. 23, 2015, now U.S. Pat. No. 9,273,431, which is a continuation of U.S. patent application Ser. No. 14/198,754, filed Mar. 6, 2014, now U.S. Pat. No. 8,940,133, which is a continuation of U.S. patent application Ser. No. 13/683,642, filed Nov. 21, 2012, now U.S. Pat. No. 8,668,806, which is a divisional of U.S. patent application Ser. No. 11/412,593, filed Apr. 27, 2006, now U.S. Pat. No. 8,317,975, which is a continuation-in-part of International Application No. PCT/US2005/013216 filed Apr. 20, 2005, which claims benefit from U.S. Provisional application, Ser. No. 60/679,151, filed May 9, 2005 and U.S. Provisional patent application, Ser. No. 60/563,837, filed Apr. 20, 2004, which are herein incorporated by reference in their entireties.

BACKGROUND OF THE INVENTION

1. Field of Invention

The invention relates generally to the field of pulping and bleaching lignocellulosic materials. More specifically, the present invention is directed to pulping and bleaching of lignocellulosic materials which includes biopulping and/or water extraction processes.

2. Description of the Prior Art

There are a number of processes that convert lignocellulosic materials to pulp. Pulp is the fibrous slurry that is fed to a paper machine to produce paper. Mechanical, chemical and hybrid methods dominate commercial pulping plants. About 25% of worldwide pulp production is mechanical pulp. It is a high-yield process but suffers from high energy costs and damage to the lignocellulosic fibers. This damage produces lower strength paper. These disadvantages (cost and quality) limit the number of applications for pulp.

Chemical pulp is the pulp produced by chemical pulping. The dominant chemical wood pulping process is the kraft process. In this process a digesting solution of sodium hydroxide and sodium sulfide is employed. The advantage of chemical pulp is reduced damage to the lignocellulosic fibers insofar as the chemical pulping operation permits a sufficient amount of the lignin constituent in the lignocellulosic materials to be dissolved so that the lignocellulosic fibers separate without significant mechanical action.

Recently, a means for improving pulping has been developed. That new development is the addition of a biopulping step. The production of pulp begins with lignocellulosic materials, such as wood chips. When a biopulping step is used, the lignocellulosic materials are 'digested' with one or more fungi types prior to mechanical or chemical pulping. The fungi soften the lignocellulosic materials by degrading or breaking lignin-carbohydrate complexes in the lignocellulosic materials.

A process that describes bioprocessing in detail is U.S. Pat. No. 6,402,887 whose disclosure is incorporated herein by reference. That patent describes a process of biopulping of industrial wood waste using fungi which selectively degrade lignin.

After biopulping, the wood chips are mechanically or chemically pulped into individual fibers. The fungi and the produced enzymes are destroyed during the thermomechanical pulping process. Due, in large part, to the biochemical action of the fungi, less energy is required to convert the chips to fibers. Some investigators claim energy savings of at least 30%. The easier conversion from chip to fiber means less damage to the fibers. The paper formed from these fibers is stronger.

Although a biopulping step reduces the energy costs associated with pulping, it does not address the absence of recovery of the full commercial value of lignocellulosic materials. Lignocellulosic materials comprise cellulose, lignin and hemicellulose. Conventional pulping operations recover the cellulose values in the form of fibers. The value provided by lignin, which is removed in the pulping operation, is recovered as energy, by its combustion.

That is, conventional pulping, whether or not including a biopulping step, does not address a major aspect of commercial exploitation of lignocellulosic materials. As stated above, there are three major components in lignocellulosic materials. The first is cellulose. The pulping operation yields fibers which are substantially the cellulose component. A second component is lignin, which is removed in the pulping operation. Indeed, biopulping involves fungal digestion of lignin. The third component, which is usually utilized for its energy value, along with the lignin, is hemicellulose.

Hemicellulose is a mixture of sugar and sugar acids, a major component of which are xylans. The difficulty in the prior art of isolating the product values of hemicellulose has limited the utility of the hemicellulose component in wood to the marginal energy value of that component. An acid pretreatment can be used to depolymerize the xylan to xylose and xylose oligomers. The acid would also catalyzes hydrolysis of acetyl groups (2-4.5% of the weight of the original wood) to acetic acid. If the wood is treated with hot water a low initial rate of acetic acid would be obtained. However, each acetic acid molecule formed would then act as an acid catalyst in a process referred to as autohydrolysis.

Additionally, there are some drawbacks to biopulping, such as a reduction in the brightness and opacity of the resulting fibers. Since the production of higher quality papers is desirable, use of biopulped fibers will require improvements in brightness and opacity. Research is underway to develop strategies to address these drawbacks. Preliminary bleaching studies with hydrogen peroxide and addition of calcium carbonate to improve both brightness and opacity have met with early success.

The present invention provides a method for producing pulp that addresses the above and other issues.

BRIEF SUMMARY OF THE INVENTION

The present invention is directed to an omnibus process of pulping lignocellulosic materials, especially wood chips, wherein many of the problems of both mechanical and chemical pulping in terms of pulping efficiency, production of quality paper and recovery of chemical values, is optimized.

In accordance with the present invention a process of pulping lignocellulosic materials is provided. In one aspect of the present invention lignocellulosic materials are treated with a fungus that breaks lignin-carbohydrate complexes. The lignocellulosic materials product of this contact is thereupon mechanically, chemically or mechanically-chemically pulped. The pulp product of this step is bleached. That bleaching step occurs in the presence of an enzyme which breaks lignin-carbohydrate complexes. In a preferred embodiment that enzyme is the crude broth product of the fungus contacting step. The lignocellulosic materials product that is not pulped and the pulp which is not bleached is combusted.

In another aspect of pulping lignocellulosic materials in accordance with the present invention lignocellulosic materials, whether or not contacted with a fungus that breaks lignin-carbohydrate complexes, is contacted with hot water at a temperature in the range of between about 20° C. and about 200° C. and a pH in the range of between about 0.5 and about 6.9 for a period in the range of between about 1 minute and about 7 days. The product of this extraction is an aqueous extract and extracted lignocellulosic materials. The extracted lignocellulosic materials are pulped and subsequently bleached. The extracted lignocellulosic materials not subject to pulping is combusted.

In yet another aspect of the process of pulping lignocellulosic materials of the present invention a charge of a lignocellulosic material is contacted with a fungus which breaks lignin-carbohydrate complexes in lignocellulosic materials. The lignocellulosic material product of this contact is contacted with water at a temperature in the range of between about 20° C. and about 200° C. and a pH in the range of between 0.5 and about 6.9 for a period of time in the range of between about 1 minute and about 7 days wherein an aqueous extract and the extracted lignocellulosic material product is obtained. The extracted lignocellulosic material product is pulped wherein individual fibers and fiber bundles are produced. The pulp product of this step is bleached. Finally, the extracted lignocellulosic product not subjected to pulping and bleaching is combusted.

In still another aspect of the process of pulping lignocellulosic materials of the present invention a charge of lignocellulosic material is pulped wherein individual fibers and fiber bundles are produced. The pulped product is thereupon bleached by contacting the pulped product with chlorine dioxide in the presence of an agent selected from the group consisting of oxygen, magnesium hydroxide, another magnesium-containing compound, oxygen and magnesium hydroxide or another magnesium-containing compound, potassium hydroxide and calcium hydroxide.

Finally, in another aspect of the present invention, a pulp, produced in accordance with the process of pulping lignocellulosic materials, is provided. The pulp has a specific surface area in the range of between about 5,000 $cm^2/g$ and about 40,000 $cm^2/g$ and a specific volume in the range of between about 1.5 $cm^3/g$ and about 4.0 $cm^3/g$.

BRIEF DESCRIPTION OF THE DRAWINGS

The present invention will be better understood by reference to t following drawings of which.

DETAILED DESCRIPTION OF THE INVENTION

The pulping process of the present invention begins with the raw material utilized in the production of pulp and its by-products—lignocellulosic materials. The lignocellulosic materials utilized in pulping are woods, grasses and the like. The classes of wood within this category include wood chips or tree species especially useful as a biomass fuel, e.g., a shrub willow (*Salix dasyclados*) and the like. In general, woods not suitable for use as lumber and certain species of grass are most commonly employed as raw materials in pulp and subsequent paper production.

Figure 3:
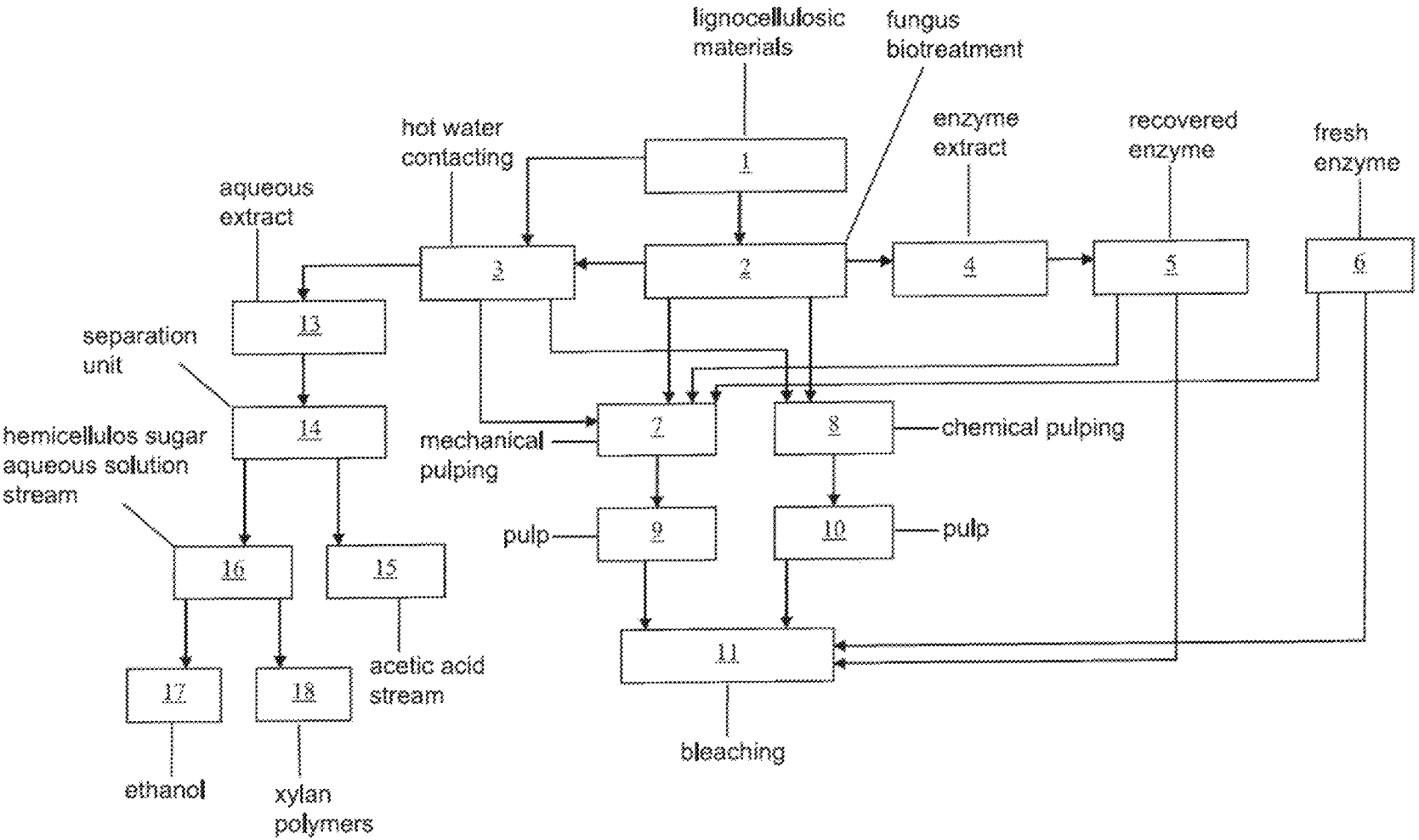
FIG. 3 is a schematic flow diagram of the omnibus pulping process of the present application.

Lignocellulosic materials, denoted at 1, in accordance with the omnibus process depicted in FIG. 3, is, in one preferred embodiment, subjected to hot water contact 3. In this step, water, at temperature in the range of between about 20° C. and about 200° C. and a pH in the range of between about 0.5 and about 6.9 contacts a charge of the lignocellulosic material for a period in the range of between about 1 minute and about 7 days. More preferably, the water is at a temperature is in the range of between about 100° C. and about 160° C., at a pH is the range of between about 2.0 and about 5.0 and a contact time between the lignocellulosic material charge and the hot water in the range of between about 10 minutes and about 4 days.

This contacting step, which serves as an extraction step, represents a significant advance in the art insofar as this step not only enhances the rate of pulping, which is conducted subsequent to this step, but, in addition, the step that occurs downstream of the pulping step, pulp bleaching, is more successful. That is, the bleaching step of the present invention yields a pulp having greater brightness than the pulp prepared from the same lignocellulosic material not subjected to the hot water extraction of the present process. It is furthermore theorized that the carbohydrate/cellulose of the brighter pulp, resulting from the step, has a higher average degree of polymerization which results in paper and paperboard products having higher strength properties than similar products produced from pulp not subjected to hot water extraction.

In regard to the rate of pulping, it is found that the rate of pulping is increased by between about 1.2 and about 12 times than an identical pulping step in which the same lignocellulosic materials are not subjected to this hot water extraction step.

The hot water contacting step 3 produces an extracted lignocellulosic product and an aqueous extract. The extract 13, an aqueous solution, is subject to further processing to recover chemical values present in the original lignocellulosic materials charged into the process. The aqueous extract 13, in accordance with this aim, is passed into a separation unit 14. In a particularly preferred embodiment molecular separation is employed to effectuate this result. Specifically, a molecular separation occurs, preferably employing a mono-sized porous membrane, which effects separation of hemicellulose sugars and acetic acid, extracted from the lignocellulosic materials charge, present in the aqueous extract 13.

This separation permits recovery of material values inherent in lignocellulosic materials. Acetic acid is a highly prized commodity chemical. Hemicellulose sugars, principally xylans, can, in the absence of the separated acetic acid, be fermented to produce ethanol and other valuable fermentation products. Xylans can also be polymerized to produce important xylan polymers.

As depicted in FIG. 3, the aqueous extract 13 is separated by molecular separation 14 into an acetic acid stream, accumulated at 15 and a hemicellulose sugar aqueous solution stream collected at 16. The hemicellulose sugar can, in the absence of acetic acid, be fermented to produce ethanol and other commercially valuable fermentation products. Ethanol and other fermentation products are illustrated by reference numeral 17. Alternatively, the xylan sugar 16 can be polymerized to product xylan polymers 18.

The lignocellulosic material after hot water extraction is next subjected to pulping. Pulping is effectuated by chemical pulping, mechanical pulping or a combination of mechanical and chemical pulping. Mechanical pulping, denoted by reference numeral 7, is effectuated by methods known in the art. Usually, mechanical pulping involves grinding the lignocellulosic materials on a pulpstone refiner, e.g. a rotating disk attrition mill.

Chemical pulping, denoted by reference numeral 8, may be utilized in the pulping step. A predominant chemical pulping method is the kraft process. In the kraft process an alkaline pulping liquor or digesting solution includes sodium hydroxide and sodium sulfide. In a preferred embodiment the two components are present in a weight ratio of about 3:1, sodium hydroxide to sodium sulfide.

In another preferred embodiment chemical pulping is effectuated by a kraft process modification. That is, the kraft process is modified by the addition of polysulfide which are introduced under alkaline conditions and relatively low temperature, e.g. about 100° C. to about 120° C.

Another modification of the kraft process that may utilized in the chemical pulping process is the addition of an anthraquinone. In a preferred embodiment of this process, kraft cooking in the presence of an anthraquinone, for example, sodium anthraquinone-2-sulfonate, is added to the sodium hydroxide solution. In another embodiment of this process small amounts of a quinone salt are added to kraft pulping liquors.

Yet another chemical pulping process within the contemplation of the present invention is soda cooking. In the soda cooking process the lignocellulosic materials are contacted with sodium hydroxide. Such a process is advantageously employed when the lignocellulosic material is certain hardwood species or is a nonwood plant.

A related process that is encompassed by the chemical pulping step of the present invention is the use of the soda cooking method catalyzed by an anthraquinone.

A further related process favorably utilized in the process of the present invention is soda cooking in the presence of a redox catalyst. A preferred redox catalyst utilized in this embodiment is anthraquinone (AQ) or 2-methylanthraquinone (MAQ). Kraft pulping is the dominant process for the conversion of wood chips into pulp fibers in the United States (~85% of all virgin pulps from wood chips). The key to the kraft process is the Tomlinson furnace that is quite efficient at recovering the pulping chemicals, NaOH and $Na_2S$. However, energy efficiency is becoming more important each passing year and there is a sense of inevitability that gasification of the black liquor (BL) will replace the Tomlinson furnace for chemical and energy recovery. The current estimates are that an optimized Tomlinson furnace would net ~900 kWh/ton of pulp while a gasifier would net around 2,200 kWh/ton of pulp. Gasification would allow a mill to generate more thermal energy and also more electricity via turbines or micro-turbines. Also, low quality biomass (LQB) could be mixed into the BL to generate even more energy.

A major sulfur related problem is that the regeneration of $Na_2S$ from kraft BL would be tedious for all gasification processes. Some of the sulfur in the BL will be converted to $H_2S$ in the fuel gases (Eqn. [1]). This $H_2S$ has to be selectively removed by adsorption onto a solid sorbent or into a solvent. The $H_2S$ would have to be desorbed from the solid sorbent and the surface reconditioned for another sulfidation cycle. If the $H_2S$ is absorbed into a solvent then desorption into a non-reactive gas followed by re-absorption into NaOH or $Na_2CO_3$ would be required. Poor efficiency and selectivity was observed when direct absorption into caustic was attempted at the New Bern mill where pilot scale gasification of kraft BL is being attempted.

$$Na_2S+CO_2+H_2O \rightarrow H_2S+Na_2CO_3 \quad [1]$$

The chemicals in the soda/AQ process would be NaOH or KOH plus 0.05-0.1% AQ on chips. The small amount of residual AQ can be sent to a gasifier since it is composed of carbon, hydrogen and oxygen only.

Yet another chemical pulping process utilized in the present invention is chemical pulping conducted in the presence of an anion selected from the group consisting of a carbonate, bicarbonate, sulfite, bisulfite and mixtures thereof. In this process sodium carbonate is presently used to delignify wood to ~85% yield in semi-chemical pulping operations, i.e. a hybrid process between chemical and mechanical pulping. Chemicals pulps are also produced by sulfite and bisulfite cooking processes and carbonate and bicarbonate anions are used for pH adjustment.

In still another method of the chemical pulping step of the process of the present invention, chemical pulping, is conducted in the presence of a base selected from the group consisting of potassium hydroxide, calcium hydroxide and magnesium hydroxide.

Recent results indicate that potassium hydroxide affords superior delignification to sodium hydroxide in both soda and soda/AQ pulping of both un-extracted and hot water pre-extracted (HWP-E) chips. A weaker base such as $Ca(OH)_2$ or $Mg(OH)_2$ may be able to replace NaOH or KOH for HWP-E chips that are easier to delignify. We have also performed pulping trials with $Mg(OH)_2$ and oxygen.

The pulping step, in another preferred embodiment, is carried out by a combination of mechanical and chemical pulping. This process, sometimes referred to as a semi-chemical process, is essentially a chemical delignification process in which the chemical reaction is stopped at the point where mechanical treatment is necessary to separate fibers from the partially cooked lignocellulosic materials. Any of the chemical pulping processes discussed above may be utilized in the chemical pulping phase of the combined mechanical and chemical pulping operation. In view of the similarity of between chemical processing and a combination of mechanical and chemical processing, this processing step is denoted in FIG. 3 by the same reference numeral employed to designate chemical pulp processing, reference numeral 8.

The pulp 9, produced in the mechanical pulping step 7 or the pulp 10 produced in the chemical pulping or the combination of mechanical and chemical pulping step 8, is thereupon bleached in a bleaching step 11.

In the preferred embodiment wherein pulp 9, produced by mechanical pulping 7, is bleached, it is preferred that bleaching be accomplished by contacting the pulp with a strong oxidizing agent. A particularly preferred oxidizing agent employed in this bleaching step is hydrogen peroxide.

In the preferred embodiment wherein pulp 10, prepared by chemical pulping or by a combination of chemical and mechanical pulping, is bleached, bleaching is effectuated by contacting the pulp with an oxidizing agent selected from the group consisting of oxygen, hydrogen peroxide, ozone, peracetic acid, chlorine, chlorine dioxide, a hypochlorite anion and mixtures thereof.

In one particularly preferred embodiment, the pulp 10 is bleached in two oxygen-contacting stages. In that preferred embodiment, it is desirable that there be a washing step between the two oxygen-contacting stages. Alternatively, that preferred embodiment with oxygen and sodium hydroxide between the two oxygen-contacting stages.

In another preferred embodiment, the bleaching of pulp 10 includes contacting pulp 10 with chlorine dioxide in the presence of at least one additional agent. In one preferred embodiment, the additional agent is oxygen. In another preferred embodiment, the additional agent is magnesium hydroxide or another magnesium-contacting compound. In yet another preferred embodiment the additional agents are oxygen and magnesium hydroxide or another magnesium containing compound. In still another preferred embodiment, the additional agent is potassium hydroxide or calcium hydroxide.

In a second aspect of the present invention the initial step, prior to hot water extraction, involves a biopulping step 4 wherein a charge of a lignocellulosic material is contacted with at least one fungus that breaks lignin-carbohydrate complexes (LCC) in lignocellulosic materials. Preferably, fungi which degrade lignin are utilized. Particularly preferred fungi of this type are species of *Cerioporiopsis, Trametes* and *Phlebia*. These fungi exude a lignin-degrading enzyme which permit their digestion of lignin.

Upon contact, the fungus grows on the lignocellulosic material at a relatively slow rate compared to normal processing time scales in the pulp industry. The treatment of lignocellulosic material with at least one LCC breaking fungus, preferably a lignin-degrading fungus, can take anywhere from two to six weeks or longer depending on the degree of treatment desired. The treatment time can be shortened by using greater concentrations of fungi initially but this comes at higher cost. Previous related work has indicated that the inoculation amounts (5 g/ton of lignocellulosic material) and treatment time of 2 weeks are reasonably feasible from an economic standpoint. Moreover, the use of a biological agent does not cause contamination or health concerns relating to concentrated cultures of microorganisms since the organisms used are all naturally-occurring and limit their attack to lignocellulosic materials.

As stated above, in this preferred embodiment the fungus-treated lignocellulosic material is thereafter subjected to the aforementioned hot water treatment. The product of the fungus biotreatment 2, an enzyme extract 4 is separated and may or may not be recovered. In the preferred embodiment wherein the enzyme is recovered, the recovered enzyme is denoted by reference numeral 5. That enzyme extract 5 is obtained as a course broth or as a pressate, obtained by the application of mechanical pressure to the fungus-treated lignocellulosic material. A concentrated broth is thereupon formed by centrifugation. The recovered enzyme broth may be utilized in subsequent steps of the process.

The biopulped lignocellulosic material is thereupon treated in accordance with the first discussed embodiment of the process of the present invention. That is, the biopulped lignocellulosic material is subjected to the hot water extraction step 3 whereafter the lignocellulosic material is pulped. Again, pulping is effectuated by mechanical pulping, chemical pulping or a combination of mechanical and chemical pulping.

It is emphasized that the aqueous extract, Obtained in the water extraction step 3, is processed in accordance with the method discussed supra to obtain acetic acid and hemicellulose aqueous solutions.

In the preferred embodiment wherein mechanical pulping is utilized, the pulping processing is, but for one aspect, substantially identical to mechanical pulping in the first preferred embodiment. That aspect is the optional introduction of a LCC breaking enzyme, preferably a lignin-degrading enzyme, into the mechanical pulping operation 7. In one preferred embodiment that enzyme is provided by the enzyme-containing crude broth 5 recovered in the biopulping step 2. Alternatively, in an embodiment wherein the enzyme product 4 of the fungal biotreatment step 2 is not recovered, fresh enzyme 6 may be co-introduced, with the pulp, into the mechanical pulping step 7. The introduction of enzyme into the mechanical pulping step 7 increases the rate of pulping insofar as the enzymatic removal of lignin reduces the mechanical work necessary to accomplish the same task.

In an alternate embodiment of the second aspect of the instant process, pulping is performed by chemical pulping or a combination of mechanical and chemical pulping, denoted by reference numeral 8. in this processing step, the lignocellulosic materials subjected upstream to hot water processing step 3 are pulped in accordance with the process of chemical pulping discussed in the first aspect of the process described supra.

The pulp 9, produced in the mechanical pulping step 7, or the pulp 10, produced in the chemical pulping or the combination of mechanical and chemical pulping step 8, is next bleached in bleaching step 11. In this step the pulp is whitened without adversely affecting the strength of the fibers. Bleaching step 11 in this second aspect of the present invention is conducted in accordance with the bleaching step within the contemplation of the first aspect of the process of the present invention. There is, however, one additional preferred processing step in the second aspect of the process of the present invention. That is, independent of whether pulp 9, generated by mechanical pulping, or pulp 10, generated by chemical pulping or a combination of mechanical pulping and chemical pulping, is bleached, the additional processing step of introducing an enzyme that breaks LCC bonds into the bleaching reactor is included. Preferably, that enzyme is a lignin-degrading enzyme. That enzyme may be obtained from vendors marketing such enzymes or may be the enzyme recovered from the biopulping step, e.g. the biopulping step, the fungus-lignocellulosic contacting step. These alternatives are illustrated in the drawings by enzyme 6 and recovered enzyme 5, respectively introduced into bleaching step 11.

The process of the second aspect of the process of the present invention, like the process of the first aspect of the process of the present invention, includes the step of combusting and recovering the energy values of the charge of the lignocellulosic materials not subjected to pulping and bleaching.

A third aspect of the process of the present invention involves the steps of pulping and bleaching a charge of lignocellulosic material. In that process a charge of lignocellulosic material is pulped to provide individual fibers and fiber bundles. The pulping step in this aspect of the present invention may be accomplished by mechanical pulping, chemical pulping or a combination of mechanical and chemical pulping. The preferred embodiments of these pulping methods, discussed supra, in regard to the first two aspects of the present invention, may be utilized.

The pulped product, in this third aspect of the present invention is bleached. This bleaching step involves contacting the pulped product with chlorine dioxide in the presence of an agent selected from the group consisting of oxygen, magnesium hydroxide, another magnesium-containing compound, oxygen and magnesium hydroxide or another magnesium-containing compound, potassium hydroxide and calcium hydroxide.

The specific bleaching procedures discussed supra, may all be utilized in effectuating bleaching of the pulped product. Thus, detailed preferred embodiments of bleaching, as discussed in the first aspect of the present invention are incorporated by references in detailing preferred embodiments of the instant third aspect of the present invention.

A fourth aspect of the present invention focuses upon another process of pulping and bleaching lignocellulosic materials. In this fourth aspect a charge of lignocellulosic material is contacted with a fungus that breaks LCC in the lignocellulosic material. This contact yields a biopulped lignocellulosic material and an enzyme product produced by the fungus. The enzyme product is separated and the fungus-contacted lignocellulosic material is pulped. The pulp product of the pulping step is thereupon bleached. The fungus-contacted lignocellulosic material not subjected to pulping and the pulp product of the pulping step not subjected to bleaching is combusted to recover the energy value of the charge of lignocellulosic material not utilized in recovering product values.

A further requirement of this aspect of the process of the present invention is that the bleaching step include introduction of an enzyme that breaks LCC into the bleaching apparatus, along with the pulp. In a preferred embodiment that enzyme is provided by the enzyme separated from initial charge of lignocellulosic material contacted by the fungus that breaks LCC.

Preferred embodiments concerning the details of the pulping and the bleaching steps are discussed above, in the discussion of the second aspect of the present invention and hereby incorporated into the detailed description of this fourth aspect of the present invention.

A fifth aspect of the present invention is the novel pulp produced by the first and second aspects of the present invention which includes a hot water extraction of the charged lignocellulosic materials. That pulp is characterized by a specific surface are in the range of between about 5,000 $cm^2/g$ and about 40,000 $cm^2/g$ and a specific volume in the range of between about 1.5 $cm^3/g$ and about 4.0 $cm^3/g$. Preferably, the pulp of the present invention has a specific surface area in the range of between about 15,000 $cm^2/g$ and about 25,000 $cm^2/g$ and a specific volume in the range of between about 2.75 $cm^3/g$ and about 3.75 $cm^3/g$.

The following examples are given to illustrate the scope of the present application. Because these examples are given for illustrative purposes only, the present invention should not be deemed limited thereto.

EXAMPLE 1

*Picea abies* Preparation

*Picea abies* (Norway spruce), a softwood was utilized in this example. However, different species of woods, including hardwoods and/or softwoods, can also be used. Moreover, the invention can be used with virgin wood or waste wood, including, e.g., kiln dried, air-dried and green wood from industrial, residential, sawmill, construction and demolition sources. In the present example, logs from a 79-year old tree were debarked with a 36-cm spoke shave, chipped in a Carthage 10-blade chipper, and air dried to approximately 15% moisture by spreading the chips on a tarp. The chips were then screened in a Williams classifier. All fractions were collected and the chips retained on 15.8, 12.7 and 9.25-mm screens were pooled together and sealed in plastic bags, and stored at room temperature (approximately 24° C.) for use throughout this study. TAPPI test method T-257 cm-97 was followed for all subsequent testing and samples were taken from the pooled material as needed.

TAPPI refers to the Technical Association of the Pulp and Paper Industry, Norcross, Ga. The subject areas for TAPPI Test Methods and their numbering are: (a) Fibrous Materials and Pulp Testing, T 1-200 Series, (b) Paper and Paperboard Testing, T 400-500 Series, (c) Nonfibrous Materials Testing, T 600-700 Series, (d) Container Testing, T 800 Series, (e) Structural Materials Testing, T 1000 Series, and (f) Testing Practices, T 1200 Series. The suffix following the Test Method number indicates the category of the method. Test Method numbers consist of a capital T, followed by a space, then a number (assigned sequentially within several Test Method categories), another space, a two-letter designation of classification, a hyphen, and the last two digits of the year published. The two-letter designations for classifications are: (a) om=Official Method, (b) pm=Provisional Method, (c) sp=Standard Practice, and (d) cm=Classical Method.

Fungal Pretreatment of Wood Chips

TAPPI test method T-412 om-94 was followed for moisture content determination. A 1500 g OD sample was weighed out for each bioreactor and brought up to 50% moisture content by soaking in distilled water. Bioreactors were cleaned and sterilized with a 10% (v/v) commercial Clorox bleach/90% water solution and rinsed with distilled water. Chips were layered in the reactor with 600 g on each layer; the reactor was loosely sealed with an aluminum foil cap covering the vent in the lid and then steamed for 10-minute under atmospheric conditions. The reactor was then cooled for approximately two hours until the temperature was below 30° C. The moisture content was brought up to 55% moisture by the addition 200 ml water collected during steaming plus additional distilled makeup water. Fresh fungal inoculum (2.3 ml) and 0.5% (v/v) unsterilized corn steep liquor (CSL) at 50% solids was added to the additional distilled makeup water. The fungal inoculum/corn steep liquor mixture, diluted with the distilled makeup water, was poured over the chips in the bioreactor and the cover replaced. Generally, the chips can be inoculated with the lignin-degrading fungus by providing a liquid mixture including the fungal inoculum, and applying the liquid mixture to the chips. The inoculated chips were then incubated under conditions favorable to the propagation of the lignin-degrading fungus through the chips. Specifically, the bioreactor was then placed in the incubation chamber at 27° C. with forced continuous flow of warm humidified air at a rate of 0.028 cubic meters per minute. House air was measured by a flow meter and humidification was controlled by passing air through two water filled two-liter glass sidearm flasks (in series) through a fitted ground glass sparger. The sidearm flasks were immersed in a 40° C. water bath. From the hot water flasks, the warm humidified air passed though a water trap and a final filtering through a 0.2 micron Millipore air filter (for sterilization) before connecting to the individual bioreactors.

At daily intervals, the warm humidified air flow-rate was measured and corrected if needed and the chips were checked for contamination. At weekly intervals, the water trap in the bottom of the incubation locker was emptied and one layer of chips was removed from the reactor placed in a plastic bag, sealed and frozen at −20° C. until further processing.

TMP Refiner Mechanical Pulp Production (KRK)

Air-dried and screened *Picea abies* wood chips (800 g OD) were brought up to 10% moisture content and placed in the sample hopper on the pressurized refiner (Kumagai Riki Kogyo Co. Ltd., Tokyo, Japan, Model BRP45-30055). Low-pressure steam (32 $kPa_g$) softened the wood chips for three minutes. The TMP produced was sealed in a 40-liter Nalgene® carboy and refrigerated at 4° C. until use.

Culture Supernatant Purification

Purification involved monitoring laccase and manganese peroxidase activity and harvesting the mycelium from *P. subserialis* (RLG6074-sp), *C. subvermispora* (L-14807 SS-3), and *T. versicolor* (FP-72074) on the first day after peak laccase activity. Mycelium was harvested from the liquid culture by centrifuging for 20 min. at 10,000 rpm, followed by treating the crude supernatant with 10% (v/v) acetone and refrigerating for one hour at 4° C. to precipitate any extracellular polysaccharide. The broth was centrifuged again for 20 minutes at 10,000 rpm and filtered through a Whatman glass microfiber GF/A 42.5-mm diameter filter. The resulting supernatant was concentrated in a DC-2 ultrafiltration unit (Amicon Corp., Danvers, Mass.) equipped with a 30-kDa molecular weight cutoff hollow fiber filter from an initial volume of 1000 ml to 100 ml. Enzyme activity was monitored at harvest time and after the final concentration.

Enzyme Treated TMP

First-stage coarse thermomechanical pulp was treated with partially purified culture supernatant from *P. subserialis, C. subvermispora*, and *T. versicolor* at a dosage determined by normalizing to a manganese peroxidase enzyme activity of 1500 nkatal $1^{-1}$. Duplicate reaction vessels contained 2.0 g OD coarse refiner mechanical pulp that was suspended in 5% (w/v) 50-mM sodium acetate buffer (pH 4.5). The pulp in each reaction vessel was mixed with concentrated enzyme broth at a normalized enzyme activity of approximately 1.50 nkatal $ml^{-1}$ manganese peroxidase. Laccase activity was measured and monitored throughout the experiment. For each fungus, one reaction vessel was setup in duplicate for analysis at 0, 30, 60, 90, 180 and 360-minute intervals in a constant temperature bath of 30° C. Initial and final laccase and manganese peroxidase enzyme activity were measured for each time interval followed by a complete lignin analysis at each time interval to evaluate the effect of the enzymes on refiner mechanical pulp.

Soxhlet Resin Extraction

Figure 11:
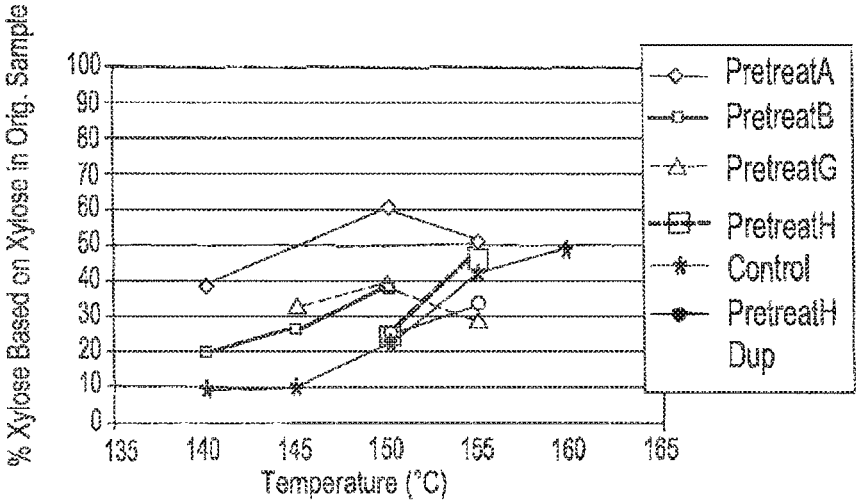
FIG. 11 is a graph showing maximum xylan recovery as a function of hot water extraction temperature in Example 3.

TAPPI test method T-264 cm 97 details the procedure followed to report chemical analysis on an extractive free basis. Air-dried Wiley milled samples (approximately 10.0 g) of both pretreated wood samples and mechanical pulp were placed in an OD tarred 45×105-mm extraction thimble. The extraction thimble was placed into a 50-mm Soxhlet extractor fitted with an Allihn condenser and a 500-ml round bottom three-neck flask (FIG. 11). Boiling chips were added to the boiling flask with 300 ml of the ethanol-benzene mixture. Samples were extracted for eight hours at brisk boiling with siphoning at approximately ten-minute intervals. After eight hours, the extraction thimbles were removed from the Soxhlet extractors, washed with 100% pure ethanol by placing the thimble in a 100 ml coarse ground glass crucible fitted on a 1000-ml sidearm flask. The thimble was returned to the Soxhlet extractor and extracted for four hours with 100% pure ethanol. The samples were transferred to a Buchner funnel and washed with hot water to remove the ethanol and then allowed to air dry for all subsequent carbohydrate and lignin analyses.

Enzyme Extraction from Wood Chips

*Picea abies* chips were prepared as previously described, inoculated with *Phlebia subserialis, Ceriporiopsis subvermispora*, and *Trametes versicolor*, and incubated for 30 days at 27° C. with forced warm humidified air at a rate of 0.028 cubic meters per minute. The chips were thus incubated under conditions favorable to the propagation of the lignin-degrading fungus through the chips. Duplicate 500-g samples were removed from each bioreactor, and double-bagged in 6×9 zip lock bags. One bottom corner of the double bag was cut off with scissors. The stainless steel plates on the top and bottom pressing surfaces of the Williams press (Williams Apparatus Co., Watertown, N.Y.) were cleaned first with soap and water and then dried with ethanol. The press was blocked up at a 45° angle and secured. The zip lock bag containing the sample was placed between the pressing surfaces and a clean 20-dram vial was placed under the cut corner of the bag. Pressure was applied (1500 psi) to the sample and the pressate was captured in the glass vial as a crude broth. Laccase and manganese peroxidase enzyme assays were performed on each vial to determine the enzyme present and enzyme concentration.

Enzymatic Treatment of TMP

Extracellular lignolytic enzymes secreted into the production and growth media were identified, monitored for peak concentration within the production media, harvested for additional experimentation and finally concentrated tenfold. The broth was centrifuged for 20 minutes at 10,000 rpm and filtered through a Whatman glass microfiber GF/A 42.5-mm diameter filter. The resulting supernatant was concentrated in a DC-2 ultrafiltration unit (Amicon Corp., Danvers, Mass.) equipped with a 30-kDa molecular weight cutoff hollow fiber filter from an initial volume of 1000 ml to 100 ml. Laboratory analysis of fungal growth established the initial growth conditions and approximate harvesting time for peak production. The enzyme concentration was then adjusted to 1.4 nkatal/ml and were used to treat $1^{st}$-stage TMP as a method to reduce the amount of lignin within the pulp, reducing the electrical refining energy and thereby increasing pulp strength. This system can also be used as a first-stage biobleaching of mechanical pulp. Throughout the experiment, the enzyme activity levels were monitored, followed by a lignin analysis of the TMP. Table 1 lists the laccase and manganese peroxidase enzyme activity levels throughout the pulp treatment. Initial activity was measured from the concentrated production medium before addition to each sample and then the manganese peroxidase enzyme concentration was normalized to approximately 1.50 nkatal $ml^{-1}$ for the zero-time condition. The laccase and manganese peroxidase activities were measured and monitored for the change in activity over time.

TABLE 1

Enzyme activity change over the 6-hour treatment time of thermomechanical pulp with partially purified lignolytic enzymes from *P. subserialis*, *T. versicolor* and *C. subvermispora*

| | Initial Activity | 0 minute | 30 minute | 60 minute | 90 minute | 180 minute | 360 minute |
|---|---|---|---|---|---|---|---|
| *P. subserialis* harvested at 7 days | | | | | | | |
| Laccase (nkatal/ml) | 12.15 | 7.63 | 7.45 | 7.55 | 6.67 | 6.26 | 5.95 |
| MnP (nkatal/ml) | 2.42 | 1.52 | 1.49 | 1.42 | 1.37 | 1.32 | 1.28 |
| *T. versicolor* harvested at 10 days | | | | | | | |
| Laccase (nkatal/ml) | 1849.8 | 822.6 | 819.2 | 815.4 | 813.5 | 811.0 | 797.2 |
| MnP (nkatal/ml) | 3.62 | 1.61 | 1.59 | 1.57 | 1.53 | 1.52 | 1.46 |
| *C. subvermispora* harvested at 12 days | | | | | | | |
| Laccase (nkatal/ml) | 864.9 | 864.9 | 865.2 | 862.4 | 858.8 | 854.2 | 852.7 |
| MnP (nkatal/ml) | 1.56 | 1.56 | 1.54 | 1.49 | 1.38 | 1.27 | 1.16 |

Laccase from *P. subserialis* showed a 22% decrease in activity while *T. versicolor* and *C. subvermispora* showed much smaller changes in activity, 3.1 and 1.4%, respectively. This difference may not be significant due to the much lower laccase activity in the enzyme broth from *P. subserialis*. Initial manganese peroxidase activity levels were on the same order of magnitude for all three fungal extract applications. The range in overall manganese peroxidase activity loss was from 15.8% for *P. subserialis* to 8.9 and 25.7% loss for *T. versicolor* and *C. subvermispora*, respectively.

Figure 1:
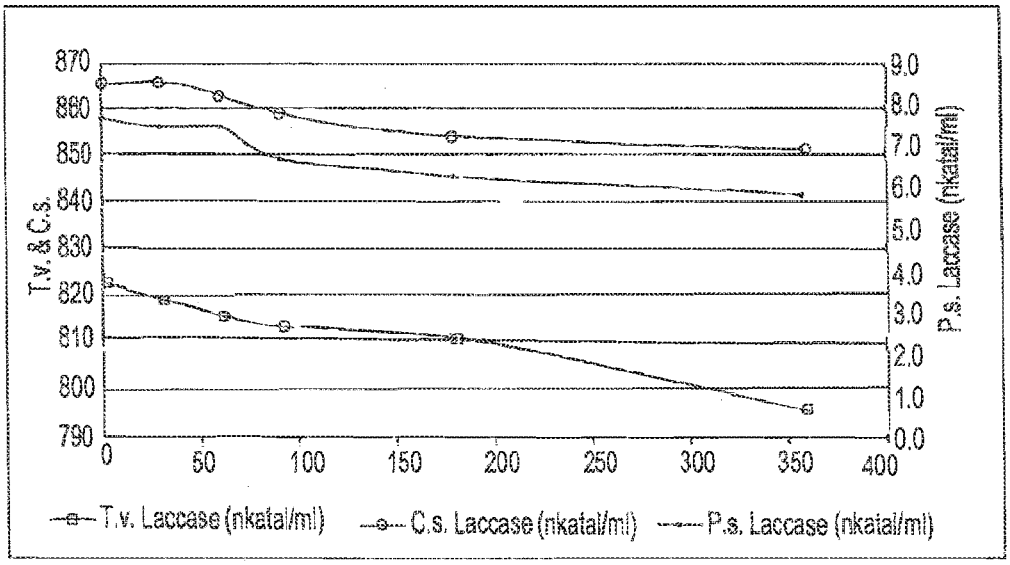
FIG. 1 illustrates the lignolytic enzyme activity change for the laccase enzyme, where thermomechanical pulping (TMP) is performed over a six hour treatment time on *Picea abies* (Norway Spruce) wood chips with fungal treatment using *P. subserialis, T versicolor* and *C. subvermispora*, in accordance with Example 1.
Figure 2:
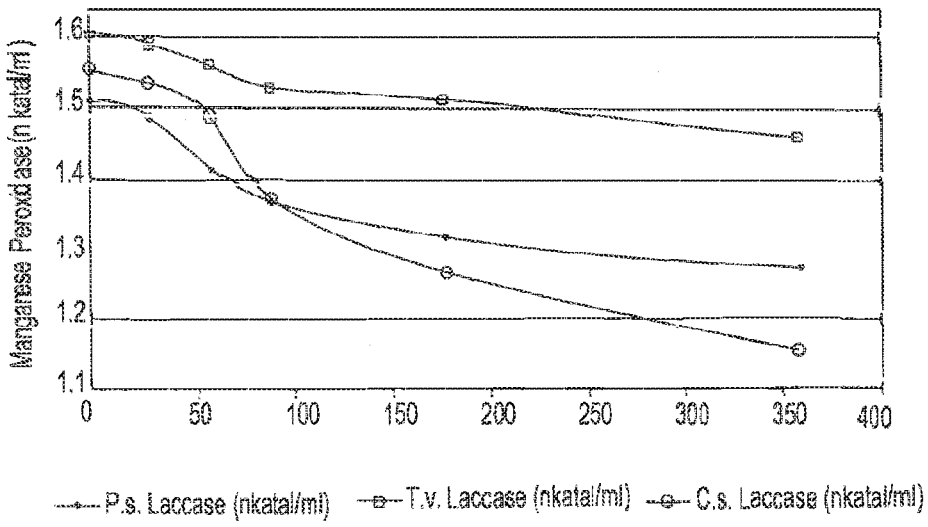
FIG. 2 illustrates the lignolytic enzyme activity change for the manganese peroxidase enzyme, for comparison with the results of FIG. 1 in Example 1.

FIGS. 1 and 2 chart the enzyme activity throughout the experiment and show the decrease in activity over the life of the experiment. In particular, FIG. 1 illustrates the lignolytic enzyme activity change for the laccase enzyme, where thermomechanical pulping (TMP) is performed over a six hour treatment time on *Picea abies* (Norway Spruce) wood chips with fungal treatment using *P. subserialis, T. versicolor* and *C. subvermispora*. FIG. 2 illustrates the lignolytic enzyme activity change for the manganese peroxidase enzyme, for comparison with the results of FIG. 1. In FIG. 1, the horizontal axis denotes time, in minutes, from 0 to 400 minutes, while the left hand vertical axis denotes T.v. and C.s. laccase activity, and the right hand vertical axis denotes P.s. laccase activity. In FIG. 2, the horizontal axis denotes time, in minutes, from 0 to 400 minutes, while the left hand vertical axis denotes manganese peroxidase activity.

Table 2 outlines the results from lignin analysis on the TMP, showing that the lignolytic enzyme treatment from *C. subvermispora* removed up to 3.66% of the lignin in the sample over a six-hour period, while *P. subserialis* and *T. versicolor* reduced the lignin content by similar amounts, 2.35 and 2.67%, respectively. *P. subserialis* showed a significant decrease in lignin content at the 90-minute sample; however, no significant change occurred after that time interval. Both *T. versicolor* and *C. subvermispora* appeared to continually decrease lignin content throughout the experiment. A longer running experiment is expected to show greater lignin losses with increased treatment time, with the enzyme activity monitored as a theoretical stopping point. These small changes in the lignin content are significant because they compare with a one to two week biopretreatment stage.

TABLE 2

Klason lignin analysis of a *Picea abies* TMP treated with partially purified enzymes from *P. subserialis*, *T. versicolor* and *C. subvermispora* over 6 hours

| Fungus | Time (min) | Total Lignin (%) | Standard deviation | Percent Loss (%) |
|---|---|---|---|---|
| Control | 0 | 29.21 | 0.29 | 0 |
| *Phlebia subserialis* | 30 | 29.17 | 0.12 | 0.14 |
| | 60 | 28.71 | 0.18 | 1.74 |
| | 90 | 28.52 | 0.60 | 2.42 |
| | 180 | 28.64 | 0.04 | 1.99 |
| | 360 | 28.54 | 0.23 | 2.35 |
| *Trametes versicolor* | 30 | 28.86 | 0.20 | 1.21 |
| | 60 | 28.61 | 0.53 | 2.10 |
| | 90 | 28.92 | 0.07 | 1.00 |
| | 180 | 28.35 | 0.25 | 3.03 |
| | 360 | 28.45 | 0.33 | 2.67 |
| *Ceriporiopsis subvermispora* | 30 | 29.28 | 0.05 | −0.24 |
| | 60 | 28.70 | 0.33 | 1.78 |
| | 90 | 28.77 | 0.10 | 1.53 |
| | 180 | 28.20 | 0.38 | 3.58 |
| | 360 | 28.18 | 0.40 | 3.66 |

Lignolytic Enzyme Activity Extracted from *Picea abies*

Fresh *Picea abies* samples were treated with the three species of white-rot fungi to identify the enzymes present in the internal wood structure, measure the activity level and make comparisons with enzyme production under laboratory conditions (Table 3). A novel procedure for isolating extracellular enzymes present within the internal wood structure allowed the comparison. Specifically, duplicate 500-g samples were removed from each bioreactor, and double-bagged in 6×9 zip lock bags. One bottom corner of the double hag was cut off with scissors. The stainless steel plates on the top and bottom pressing surfaces of the Williams press were cleaned first with soap and water and then dried with ethanol. The press was blocked up at a 45° angle and secured. The zip lock bag containing the sample was placed between the pressing surfaces and a clean 20-dram vial was placed under the cut corner of the bag. Pressure was applied (1500 psi) to the sample and the pressate was captured in the glass vial. The ability of *P. subserialis* to repeatedly produce laccase under biopulping conditions was significant due the inability to repeatedly produce detectable activity in the laboratory under controlled conditions with this organism. There were large variations in detectable enzymes and activity levels under laboratory conditions and the ability to characterize the fungi under non-induced conditions, while growing in a biopretreatment environment, hold significant potential.

TABLE 3

Comparison of laccase and manganese peroxidase enzyme activity from *P. subserialis*, *T. versicolor* and *C. subvermispora*; Extracted from *Picea abies* and laboratory growth conditions

| | *Picea abies* enzyme activity ± std. dev. | Laboratory enzyme activity at harvest time |
|---|---|---|
| | *Phlebia subserialis* | |
| Laccase (nkatal/ml) | 3.66 ± 0.07 | 4.47 @ 7 days |
| Manganese peroxidase (nkatal/ml) | 0.742 ± 0.03 | 0.229 @ 7 days |
| | *Trametes versicolor* | |
| Laccase (nkatal/ml) | 3.01 ± 0.00 | 676.5 @ 10 days |
| Manganese peroxidase (nkatal/ml) | 1.25 ± 0.05 | 0.594 @ 10 days |
| | *Ceriporiopsis subvermispora* | |
| Laccase (nkatal/ml) | 2.92 ± 0.2 | 214.2 @ 12 days |
| Manganese peroxidase (nkatal/ml) | 0.322 ± 0.014 | 1.61 @ 12 days |

EXAMPLE 2

All hot water pre-extraction (HWP-E) for this example were done in M&K digesters. Alkaline pulping was conducted in the M&K digesters as well or in small autoclaves placed into the M&K digesters. Pin chips were used in the autoclaves. The extent of varied from mild to severe.

The pulping parameters were adjusted for the cooking of pin chips since these cooks were done in 250 mL autoclaves. The cooking parameters were: AA 24%, Sulfidity 26%, and LW 10:1. The autoclaves were brought up to 170° C. in 90 minutes and held there for 60, 120, and 180 minutes.

The extracted sugar maple pin chips were done similarly. The cooking parameters, except for the temperature profiles, were the same. These cooks were brought up to 170° C. in 60 minutes and held there for 15, 30, and 60 minutes consecutively.

Kappas and Viscosity Done to TAPPI Standard Methods

Exploratory Cooks for Yield Optimization

The exploratory cooks were carried out on standard sugar maple chips for yield optimization. The HWP-E was not separated from the cooks; that is the chips were left in the M&K digesters after the HWP-E was drained and immediately de-lignified by way of three types, Kraft, Kraft with polysulfide, and Soda AQ.

The standard controls on the three schemes were done on non-extracted sugar maple chips. The control parameters are seen in Table 4. In Table 4, the acrynym AA means active alkali ($NaOH+Na_2S$ on a $Na_2O$ basis). The acrynym EA means effective alkali ($NaOH+1/2Na_2S$).

TABLE 4

| Kraft Control |
|---|
| AA: 16%<br>EA: 14%<br>Sulfidity: 25%<br>L:W 5:1<br>90 min → 165° C.<br>120 min @ 165° C. |
| Kraft with Poly sulfide Control |
| AA: 16%<br>EA: 14%<br>Sulfidity: 25%<br>Polysulfie: 2% Sulfur<br>L:W 5:1<br>90 min → 165° C.<br>120 min @ 165° C. |
| Soda AQ Control |
| AA: 14%<br>AQ: 0.1%<br>$Na_2SO_3$: 0.5%<br>L:W 4:1<br>90 min → 165° C.<br>150 min @ 165° C. |

Lignin Leachability from Extracted Sugar Maple Chips

The extracted sugar maple chips delignify faster. This lead to the desire to quantify the leachability of the lignin within both extracted and non-extracted wood chips. Chips were HWP-E at 140, 150, and 160° C. for this study.

The wood chips were separated into different ½ gal "Wiffle" Reactors according to the temperatures at which they were extracted. A portion of un-extracted wood chips was also put into a "Wiffle" Reactor. These reactors are made in house and are named such, because of their resemblance to a wiffle ball. That is the reactor is cylindrically shaped with a plurality of openings even spaced on its peripheral.

Each reactor was then submerged into a separate 4 L plastic beaker containing a weak alkali solution. The solution was made up of 0.1 N sodium hydroxide at a 20:1 L:W ratio. This was an approximate volume of 3.5 L. 10 mL samples were removed periodically over the course of six days. The samples were then analyzed in a UV spectrophotometer at the peak of 205 nm.

Void Volume

It is most likely that the free volumes within these wood chips are being affected by HWP-E, that is under conditions where the chips are swollen. This was determined by measuring the amount of water encumbered by the chips. This was done on both non-extracted and extracted wood chips. The extracted wood chips used in this method were from both mild and severe HWP-E schemes.

A sample was placed into a desiccator filled with water and attached to a vacuum pump. This is a sealed system. When the pump was turned on, the chips slowly sink as the air is replaced with water within their structures. After 2 hours, the pump was turned off and floating chips were discarded.

The chips were then dried. The surfaces of the chips were dried of any free water. Next their wet weight was recorded, and then placed in a drying oven at 105° C. over night. The next day the dry weight of the chips were recorded. The difference between the two weights is the mass of water absorbed into the wood chips. Assuming standard conditions a volume was calculated for the water. Void volume as seen in the results and discussion is volume over OD chip mass, mL/g.

Kappa vs. Yield Relationship

Figure 4:
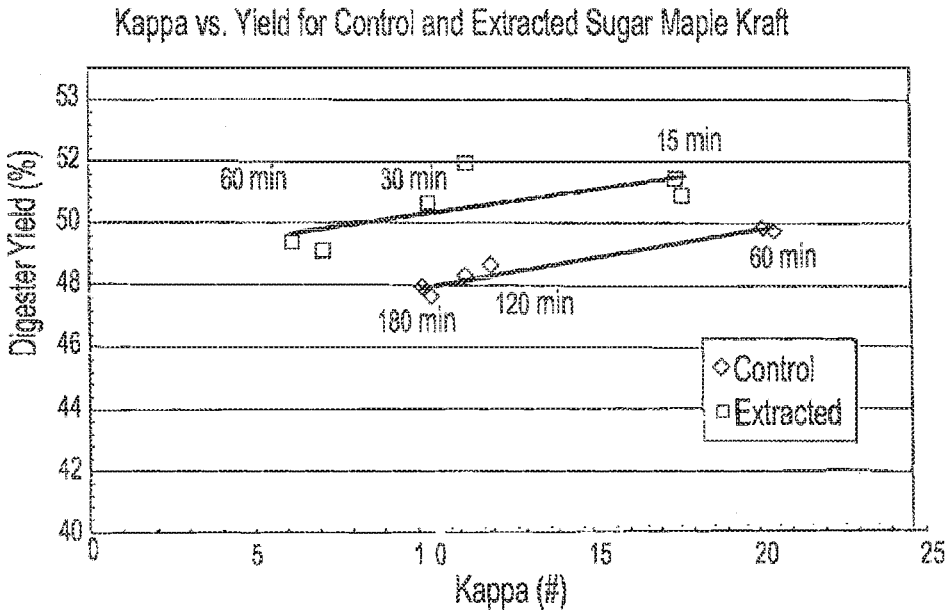
FIG. 4 is a graph demonstrating yield as a function of Kappa number in Example 2.

After more severe HWP-E, the chips cook faster under alkaline conditions. A kappa number of 17-18 can be obtained in 75 minutes, of which 60 of those minutes are the ramp time to temperature. A control cook on non-extracted wood chips took 210 minutes and was at a digester yield 2 percentage points below that of the extracted-Kraft cook as can be seen in FIG. 4. This can be deceiving, because approximately 20% of the wood mass is removed during severe HWP-E. So overall yield, pulp from chips prior to pre-treatment, is lower than wood not extracted at all.

Figure 5:
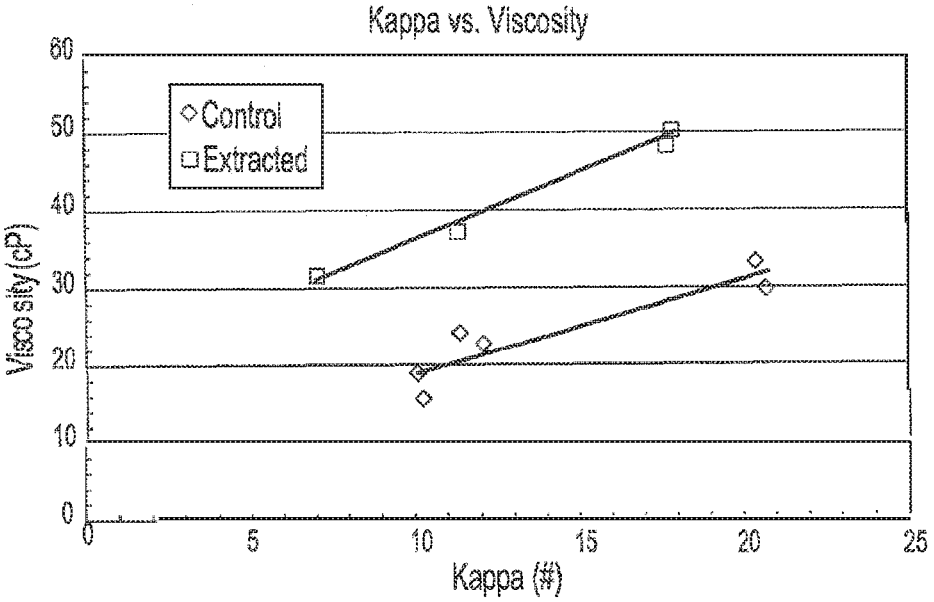
FIG. 5 is a graph demonstrating viscosity as a function of Kappa number in Example 2.

Viscosities were measured on Kraft pulp created from both extracted and non-extracted wood chips. The pulp was from the autoclave cooks. It is apparent that the extracted wood pulp has a higher Degree of Polymerization (DP). This suggests that the cellulose is damaged less, most likely because of the shorter cook times involved. The lowest point on the pre-treatment line, i.e. HWP-E, has just about the same viscosity as the highest value for the control pulps (FIG. 5). Both of these points were pulped at 60 minutes at temperature. This further supports the fact that length of time in the digesters seems to be the only variable affecting cellulose degradation between the control and pre-treated chips cooked under Kraft conditions. A viscosity of 31 cP at a Kappa number of 7 is impressive.

Exploratory Cooks for Yield Optimization

Three types of alkaline cooking were done under less aggressive HWP-E conditions to try to increase overall yield. The pHs of the extracted liquor from the more severe extractions and milder ones were similar. This supports the fact that the same amount of deacetylation was occurring in the milder extractions as in the more intense. However, the hemicellulose removal in the harsher HWP-E was much higher. Three different alkaline pulping techniques were investigated (Table 5) and the non-sulfur Soda AQ process gave higher yields than the Kraft after identical HWP-E treatment (Table 6). The same EA (14%) was used for both processes and the soda/AQ process gave a higher pulp yield even though its retention time in the alkali was longer (Table 5). This was also observed at another HWP-E treatment condition. The HWP-E might have produced more reducing end groups in the carbohydrate fraction. Oxidation of these end groups to carboxylic acids by AQ would decrease the rate of alkaline peeling during pulping.

TABLE 5

| Cooking Times (mins) | | | | |
|---|---|---|---|---|
| | | Extraction Temperature (° C.) | | |
| | Controls | 140 | 150 | 160 |
| Kraft | 90 min --> 165° C. 120 min @ 165° C. | N/A | N/A | 60 min --> 165° C. 60 min @ 165° C. |
| Kraft with polysulfide* | N/A | N/A | N/A | 60 min --> 165° C. 60 min @ 165° C. |
| Soda AQ | 90 min → 165° C. 150 min @ 165° C. | 60 min → 165° C. 120 min @ 165° C. | 60 min → 165° C. 120 min @ 165° C. | 60 min → 165° C. 120 min @ 165° C. |

*2% sulfur from polysulfide

TABLE 6

| Yields (%) | | | | |
|---|---|---|---|---|
| | | Extraction Temperature (° C.) | | |
| | Controls | 140 | 150 | 160 |
| Kraft | 51 | N/A | N/A | 47.7 |
| Kraft with polysulfide | N/A | N/A | N/A | 49.0 |
| Soda AQ | 51.2 | 52.3 | 51 | 48.9 |

Lignin Leachability from Extracted Sugar Maple Chips

Delignification is amplified as seen by the decrease in Kraft cooking times. Lignin's leachability is improved significantly by HWP-E. As temperature is increased during the HWP-E, the rate at which lignin can be removed under mild alkali conditions (0.1M NaOH and ~25° C.) is increased as well. This can be seen in FIG. 6.

Figure 6:
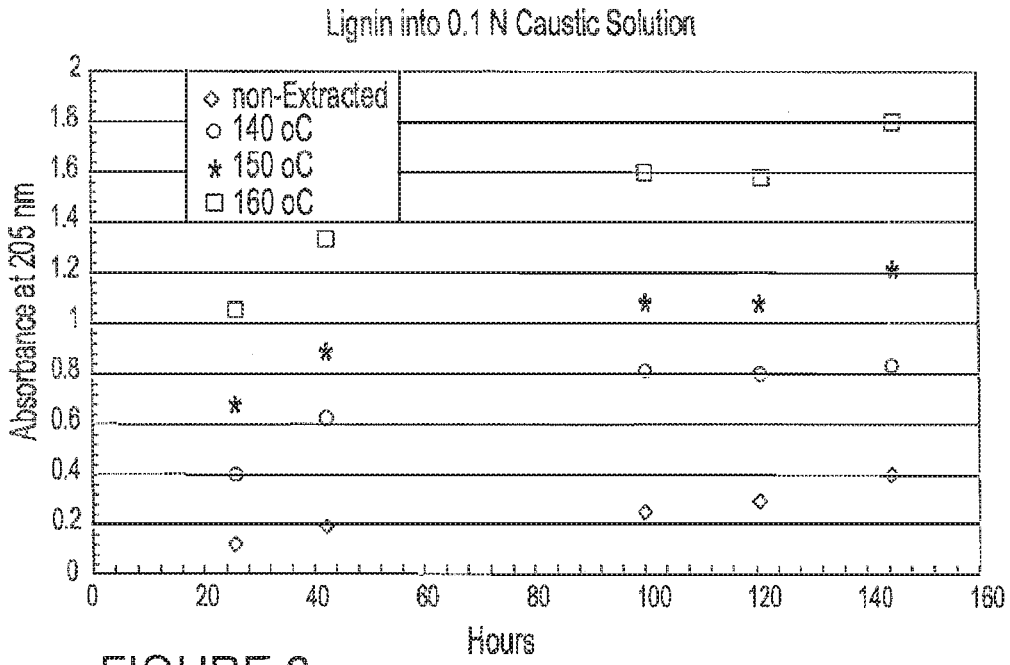
FIG. 6 is a graph showing delignification as a function of kraft cooking times in Example 2.

The data shown in FIG. 6 measures the concentration of soluble lignin leached out of both control and extracted chips into solution. The bottom set of points represent non-extracted sugar maple, and consecutively above them chips extracted at increasing temperatures.

Void Volume

Figure 7:
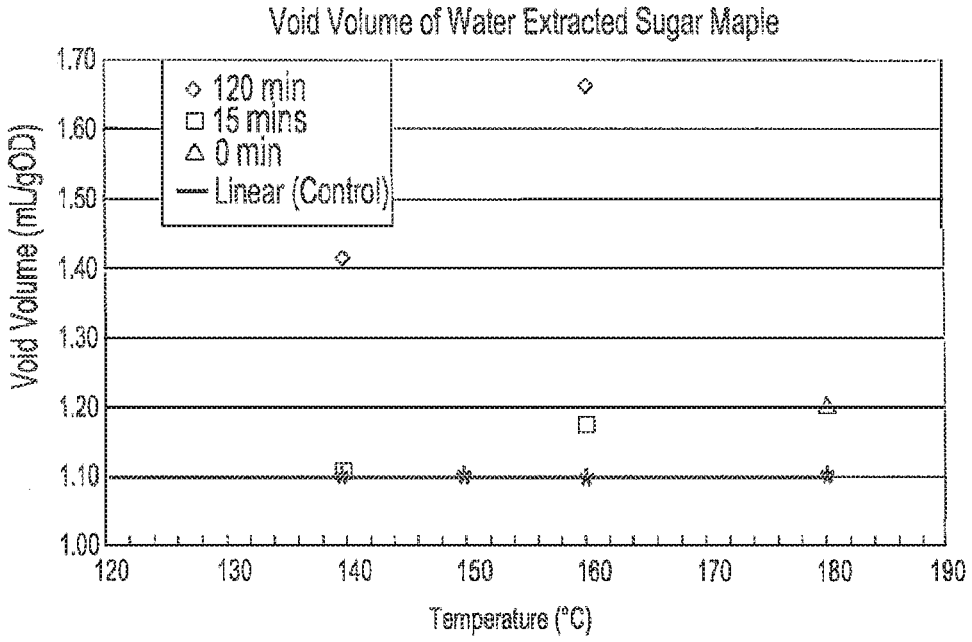
FIG. 7 is a graph demonstrating void volume of wood chips as a function of the temperatures of hot water extraction in Example 2.

Both the diffusion of pulping chemicals into a chip and diffusion of lignin out should increase with an increase in void volume. The importance of void volume on the enhancement on the rate of alkaline pulping is presently being investigated. As would be expected, the higher temperature and/or times these chips are extracted at, more mass is removed. This is consistent with the increase of void volume within the chips (FIG. 7).

Bleachability of Pulps

In one example a mixture of hardwood chips was given a HWP-E treatment and ~20% of the mass was removed. The HWP-E and un-extracted chips were both cooked to ~17 kappa number by the kraft process. When bleached by the $DE_pD$ sequence, the pulp from the un-extracted chips achieved a brightness of 86.3% while the HWP-E pulp achieved a brightness of 91.6%. In a second example, HWP-E was used to remove 12% of the mass from sugar maple chips. After soda/AQ pulping a kappa number of 16.5 was obtained. After our standard oxygen delignification the kappa number decreased by 61% to 6.5. The $O_2$ delignification results for a wide range of hardwood chemical pulps under the same standard conditions are given in Table 7. The largest decrease in kappa number was 53%.

TABLE 7

Decrease in kappa number of Conventional Hardwood Kraft Pulps caused by $O_2$ delignification.

| Pulping Process | Chip Furnish | Unbl. Kappa | $O_2$ Kappa | % Decrease |
|---|---|---|---|---|
| KL[1] | Sugar Maple | 18.5 | 9.9 | 46 |
| KL | MBA[2] | 18.0 | 8.5 | 53 |
| KL | MBC[3] | 17.4 | 10.1 | 42 |
| KL | HP 1[4] | 20.6 | 10.6 | 49 |
| KL | HP 2 | 17.0 | 8.2 | 52 |
| KL | HP 3 | 13.3 | 7.2 | 46 |
| KU | — | 13.7 | 8.6 | 37 |
| KQU | — | 17.2 | 10.4 | 40 |
| SAQ1 | Sugar Maple | 15.4 | 9.0 | 42 |
| SAQ2 | HP 2 | 16.2 | 8.7 | 46 |
| SAQ3 | HP 3 | 14.0 | 7.3 | 48 |

[1]KL = Kraft in lab; KU = Kraft in mill (conditions unknown); KQU = Kraft/AQ in mill; SAQ = soda/AQ
[2]Maple/birch/cottonwood (1:1:1)
[3]Maple/birch/aspen (1:1:1)
[4]HP = hybrid poplar In a third example a mild HWP-E was used to extract ~5% of the wood mass. Mild HWP-E is normally conducted for shorter times but with the addition of a small dose of acetic acid. In commercial practice, this acetic acid would be obtained by recycling sonic of the HWP-E effluent. Soda/AQ pulping was performed in accordance to Table 5 but for 90 instead of 120 minute. A 31 kappa number pulp was obtained but oxygen delignification decreased its kappa number by 72% to 8.8.

Conclusions

The chemical and physical properties of the wood are changed from this extraction process. Changing the material, changes the parameters required for alkali pulping. It has been observed that these extracted wood chips delignify faster to equivalent kappa numbers and yields of non-extracted wood chips. It has also been observed that higher yields can be obtained at the expense of higher kappa numbers, but these HWP-E pulps are easier to bleach, even Soda AQ pulps.

The harsher HWP-E does reduce the overall yield of a pulping process. Components removed are predominantly hemicelluloses, which do not add significantly to the final product as far as structural strength. It can be debated that it does act as an adhesive between fibers.

The milder extractions used to achieve competitive yields to conventional pulping only remove hemicelluloses to the extent of ~5% based on chip weight. This may be ideal for pulp mills, considering the shorter cooking times, higher yields, and better bleach-ability and the removal of sulfur from the process. Besides the fact, acetic acid is a higher value commodity as compared to ethanol from fermentation of extracted sugars, which likely requires greater capital than acetic acid separation. If a pulp mill were not to take advantage of the acetic acid market, very little capital would be required to modify an existing process.

A shorter time in the digester has a positive affect on the degree of polymerization of cellulose and most likely sheet strength. This has not been substantiated yet by making handsheets, but is a strong assumption. Soda AQ may be a good way to cook these extracted sugar maple chips. Eliminating sulfur would greatly simplify the recovery system and likely improve energy efficiency.

EXAMPLE 3

Materials and Methods

Preparation of the Chips

Wood chips arrived in barrels from the SUNY-ESF Genetics Field Station in Tully, N.Y. The chips were from a single harvest at four years of age of a multi-clone trial. The chips were laid out for two weeks to air dry with a resulting oven-dry (OD) solids content of 92.3%. After air-drying, the chips were well-mixed and then divided and placed into large plastic bags for storage. It was important to bring the chips to a constant and low moisture content to ensure natural degradation did not take place during storage. When chips were needed for treatment, a 1625 gram air-dry (AD) chip sample (1500 g OD) was brought up to a 50% moisture content by soaking overnight in distilled water. Xylan in wood is fairly resistant to leaching at low temperatures due to the molecular size of the polymer molecule. The soaking was done at room temperature to minimize the loss of xylan during this step.

The chips were then incubated in an aerated static bed-bioreactor consisting of 21-L polypropylene containers. The lid on the containers vented to the atmosphere through an exit tube. At the bottom of the polypropylene container, a 1-cm side opening provided for controlled inlet airflow.

Prior to inoculation, the clean, empty bioreactors were autoclaved for twenty minutes. After the chips were added to the vessel, steam was injected for thirty minutes through latex tubing connection at the bottom of the reactor. The bioreactors' lids were left slightly ajar to prevent over pressurization. After steaming, the bioreactor was drained to remove the excess water that had condensed inside the vessel. The vessel and its contents were then cooled for two hours before inoculation, with the inlet and outlet of the vessel covered with aluminum foil to avoid contamination.

Preparation of the Inoculum

*C. subvermispora* strain L14807 SS-3 (Cs SS-3) was obtained from the USDA Forest Service, Forest Products Laboratory (FPL) in Madison Wis. All stock culture slants were incubated at 26° C., stored at 4° C., and maintained at 2% (w/v) potato dextrose sugar plates. The samples were prepared and maintained as reported in Example 1.

When needed for treatment, 2.31 ml of mycelium was added to 100 ml of sterile water and blended for 75 seconds. The blending was done in 15-second intervals followed by a 15-second pause to avoid heat build up, up to a total of 75 seconds of blending. The blended mycelium was transferred to a sterile beaker, additional makeup water was added to bring the chips to a 55% moisture content, and 0.5% unsterilized corn steep liquor at 50% solids added to the beaker. The mixture was then poured over the chips in the bioreactor and mixed by shaking the bioreactor.

The bioreactors were then incubated at 27° C. with an airflow of 7.87 $cm^3/s$ (1.0 $ft^3/h$) per bioreactor. The air was humidified by flowing through two water-filled 2-L Erlenmeyer flasks through a fitted ground glass sparger. The humidified air passed through a water trap, filtered through a 0.2 μm Millipore filter, and entered the base of the bioreactor.

After the two weeks, the chips were removed from the incubator and frozen to prevent any further fungal growth prior to the analysis or subsequent extraction. The chips were kept frozen until 12 hours before they were used for xylan extraction.

Hot Water Extraction

Hot water extraction was carried out in a 4-L capacity M&K digester equipped with indirect heating through heat exchangers with forced liquor recirculation. The basket was filled with chips (1500 g OD) from air-dried willow samples for the control. For pretreated samples, the chips were removed from the freezer allowed to thaw for 12 hours. The basket was placed in the digester and distilled water was added to achieve a 4:1 liquor to wood ratio. The digester cover was then closed and the circulation pump turned on. The temperature was set (experiments were at 140° C., 145° C., 150° C., 155° C. and 160° C.) and the heaters were turned on. The chips were brought up to temperature in approximately 15 minutes and the two-hour extraction began.

After the two-hour extraction, the pump and heater were turned off and a bottom valve opened slowly to relieve the pressure and to withdraw the extract for analysis. The extract was collected through a valve and heat exchanger to cool the sample below the boiling point. The chips were washed thoroughly until a clear liquid was observed. The wash water was not collected. The chips were then placed in a drying oven at 105° C. overnight to determine the mass loss of the chips.

Extractant Composition

After the pH of the extract had been determined, a sample of the extractant was then evaporated in a 105° C. oven to determine both the solids content and to prepare a sample for the carbohydrate analysis. A 100 to 200-ml portion of the extractant was placed in small porcelain crucibles and evaporated at 105° C. in a drying oven for 3 days or until a stable weight had been achieved. The sample was weighed and then ground with a pestle. The powdered sample was then placed in a vial for subsequent carbohydrate analysis using the NMR analytical procedure.

Lignin Content

Kiason lignin of control and treated samples were determined in accordance with Tappi T-222 om-88, "Acid-insoluble lignin in wood and pulp" (Tappi, 1994). Mason lignin was used to estimate of the extent of delignification in the untreated and fungal-treated chips. The Kiason lignin method involves the hydrolysis and solubilization of the carbohydrate component of the lignified material, leaving the lignin as a residue, which is determined gravimetrically. The acid soluble lignin procedure in wood supplements the determination of acid-insoluble lignin. The soluble fraction was determined in accordance with the useful method UM 250, "Acid-soluble lignin in wood and pulp" (Tappi, 1994). The sum of the acid-insoluble lignin and of the acid-soluble lignin represents the total lignin content in a sample. The wood in this research project was not pre-extracted to remove extractives as is typically done and recommended. The pre-extraction would have removed a portion of the total mass from both the original wood sample and the final extracted wood samples.

Carbohydrate Analysis

A new method has been developed involving $^{1}$H-NMR analysis at 600 MHz at Analytical and Technical Services at ESF (Kiemle, 2001). The procedure involves hydrolyzing the samples in an acid solution, isolating the sugar monomers, and quantifying the individual sugars. The NMR procedure is relatively fast when compared to other carbohydrate analysis procedures. Samples were observable in the range of 4.4-9.0 (ppm) chemical shifts.

A known amount of rhamnose was added to check the recovery of the sugars and to verify the testing procedure. Rhamnose is a monosaccharide that is not found in appreciable quantities in most wood hydrolyzate, which gives distinct and well resolved signals associated with the respective α and β anomeric proton doublets (α signal at 5.10 ppm and β at 4.86 ppm). Prior analysis of willow showed that rhamnose is present only in trace quantities (Kiemle, 2001).

In making up the $D_2O$ solution, 0.5025 g (0.4459 g OD) of rhamnose (MC 88.74%) was added to a 100 g sample of $D_2O$. This was carefully measured out in this way to ensure that 27.1.4 mg (24.08 mg OD) of rhamnose would be in each 5.4 mL of $D_2O$ that was then added to the dispersion in the procedure described below. When exactly 1 ml of the total 6.02 ml solution was drawn, it would contain 4 mg OD of rhamnose.

Oven-dried wood samples were ground in a Wiley Mill fitted with a 20-mesh screen. Using a vacuum oven, each sample was dried overnight immediately prior to processing to remove any moisture it may have absorbed between the time it was ground and processed. For the extractant, the oven dried solids portion of the evaporated extractant was determined after grinding with a mortar and pestal.

For NMR analysis, 0.040 g of dried wood (or extracted solids) was placed in a 15-ml thick-walled pressure tube with a teflon stopper with 0.2 ml of 72% $H_2SO_4$. The dried wood dispersion is stirred and allowed to digest at 40° C. for 1.5 hours, stirring every 15 minutes. Based on preliminary testing in this study, only 15 minutes was found to be required for the hydrolysis step for the ground and dried solids portion of the extract.

After the first digestion period, 5.4 ml of the $D_2O$ solution (with rhamnose) was added to the vial. The vial was then placed in an oven at 121° C. for an additional hour. The rhamnose was added with a portion of the $D_2O$ (NMR solvent) following the last digestion step to ensure the rhamnose was not overly degraded.

After cooling the suspension to approximately 30° C., 0.4-mL of 96.6% $H_2SO_4$ was added. The developers of the NMR analysis method recommended the addition of the 96.6% $H_2SO_4$ because the lowered pH of the acidic hydrolysis medium effectively shifts the water NMR peak away from the region of C-1 anorneric protons. This step avoids the possibility of having the water interfere with the '1H signals resulting from the sugars. (Kiemle, 2001) One ml of the hydrolyzate was then transferred to a 178-mm length NMR tube for analysis. Samples were analyzed using a Bruker AVANCE 600 Mhz NMR system with the following specifications: proton frequency: 600.13 MHz, broadband observe probe type (=), (BBO): 30° C., 90° Pulse=11 μsec, recycle time: 10 sec, acquisition time: 2.73 sec, sweep width: 10 ppm, center of spectrum: 4.5 ppm, reference: acetone at 2.2 ppm. The signal intensity of the NMR resonance is directly proportional to the number of nuclei present. The response factor, the signal per mole of material, is identical for all nuclei, in all molecular environments, and is equal to unity (Kolbert, 2002).

Figure 8:
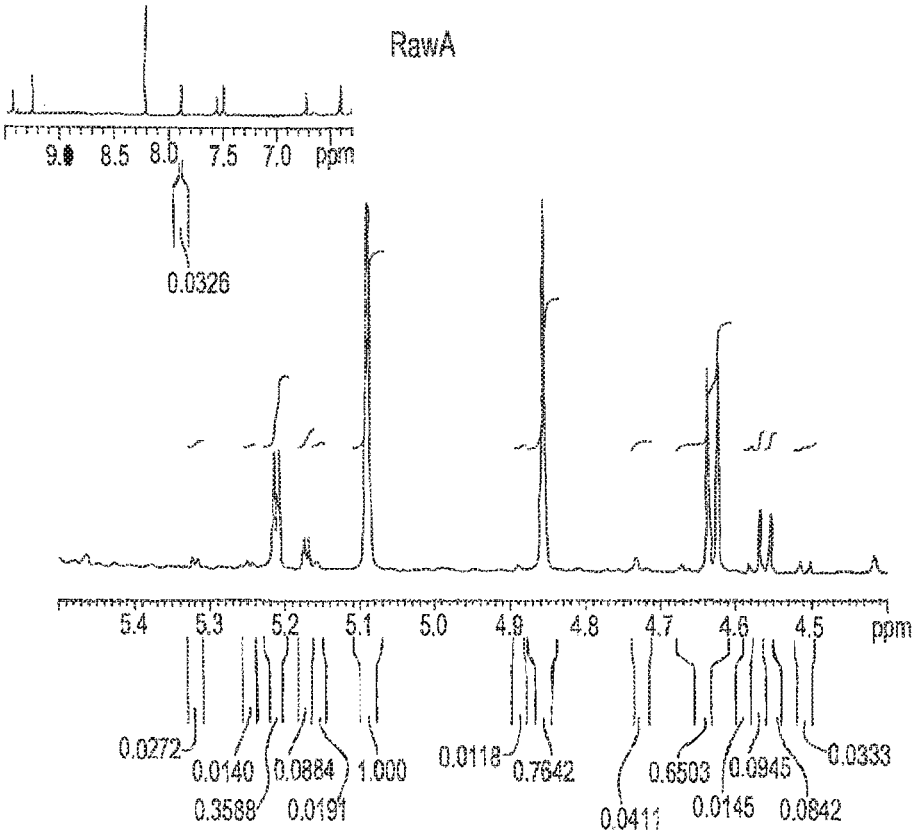
FIG. 8 is an $^1$H-NMP spectra recorded at 600 MHz for 5 sugars and the internal standard in Example 3.

The $^{1}$H-NMR spectra recorded at 600 MHz from the 5 sugars and the internal standard are given in FIG. 8 for the anomeric (C-1) region of the spectrum (4.4 - 9.0 ppm). The total concentration of each sugar is determined by summing up the total integrated area from its respective α and β anomeric proton doublets (the α doublet occurs above 5.00 ppm and the β doublet occurs below 4.95 ppm.).

Results

During the biopulping procedure, a change in the wood chip color was indicative of a successful treatment *C. subvermispora* produces a characteristic color change upon successful colonization of the wood after five to seven days of incubation. In addition, a white fungal film covering the chips after two weeks is indicative of a successful treatment. Unsuccessful treatments are missing the characteristic color change and often colonies of other organisms (such as *Aspirgillus*) are often seen. After 2 weeks of incubation with *C. subvermispora* about half of the treated willow chips appeared to have white fungal films incorporated throughout the chips. These results were in contrast to the very repeatable growth found for commercial wood chips in this apparatus. This was the first study where a large amount of bark was included with the wood chips in the reactor and further study of bark containing chips is suggested to determine if that is the cause of this variability. Only the successful treatments based on these visual criteria (i.e., A, B, G, and H) are further analyzed for their effect on xylan extraction.

The presence of the bark may have introduced variability into the process. Tests carefully comparing samples with and without bark removed would be useful. Future work could also include increasing the amount of inoculum applied to the chips when bark is present as more inoculum may be a simple way to overcome the higher potential contamination in bark containing samples.

In this work, the willow source was from a single harvest of the mixed willow clones, and the variability in Klason lignin in this sample was modest compared to reported values from other researchers who examined willow from various sources and harvest times (Deka et al, 1992). Although *C. subvermispora* has been proven to be a lignin degrader in prior works, the relatively short two-week treatment used in this work was not sufficient to reproducibly reduce the lignin content of the biomass willow chips. Very little degradation of the lignin occurred in the biomass as a result of fungal pretreatment. For example, based on the original content of wood, Pretreatment G contained 28.2%±0.9, prior to pretreatment, and 28.5%±0.6 following pretreatment. Pretreatment H contained 28.2%±0.9 prior to pretreatment, and 27.6%±0.6 following pretreatment.

Figure 9:
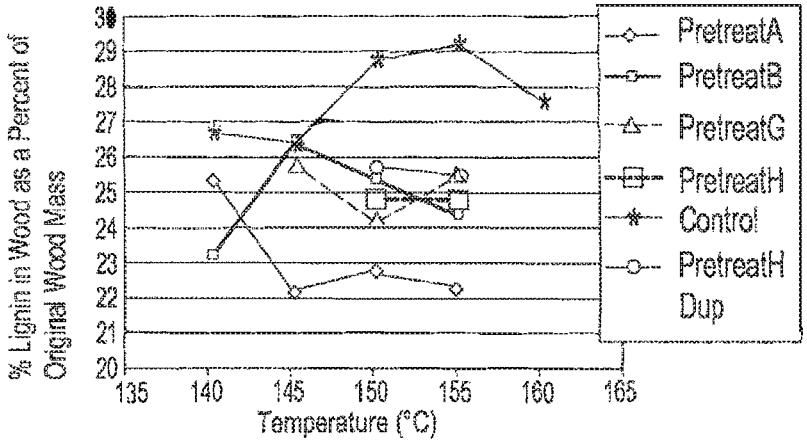
FIG. 9 is a graph demonstrating lignin remaining in wood following extraction as fraction of the original wood mass in Example 3.

FIG. 9 shows the amount of lignin remaining in the wood following the extraction based on the mass of the original wood. Although the biotreatment did not appear to remove the lignin directly, the lignin was degraded enough that an additional amount was almost always removed from the biomass by the extraction procedure. The results shown could be significant when considering the potential cost savings associated with reduced chemical charge in the digester and later in the bleach plant where chemicals are applied to break down lignin and also to brighten the residual lignin. However, this lignin comes out with the sugars in the extract and may result in additional costs for processing the extract.

Table 8 shows the results for the soluble lignin in the liquid extractant. A small portion of the lignin may have been washed away in the chip washing step following the extraction and is not captured in this analysis. The Tappi acid soluble test method mainly estimates the degradation products from lignin. The results in Table 8 may be looked at as a relative indication of the lignin content of the extract, but should be interpreted with caution as the very large dilutions necessary (over 900 times) would magnify small sample errors. It should be noted that work by Jaffe (1974) indicated that a similar hot water extraction procedure on birch extracted 5% to 30% by weight of lignin. The results in Table 8 are consistent with those of Jaffe (1974).

TABLE 8

| Sample Temp. ° C. | Pretreat A | Pretreat B | Pretreat G | Pretreat H | Pretreat H (Duplication) | Control |
|---|---|---|---|---|---|---|
| 140 | 16.40% | 12.30% | no data | no data | no data | 8.20% |
| 145 | 17.20% | 14.70% | 11.00% | no data | no data | 13.00% |
| 150 | 17.60% | 20.80% | 15.40% | 11.60% | 12.30% | 18.00% |
| 155 | 18.60% | no data | 16.00% | 14.20% | 15.60% | 16.20% |
| 160 | no data | no data | no data | no data | no data | 14.50% |

Figure 10:
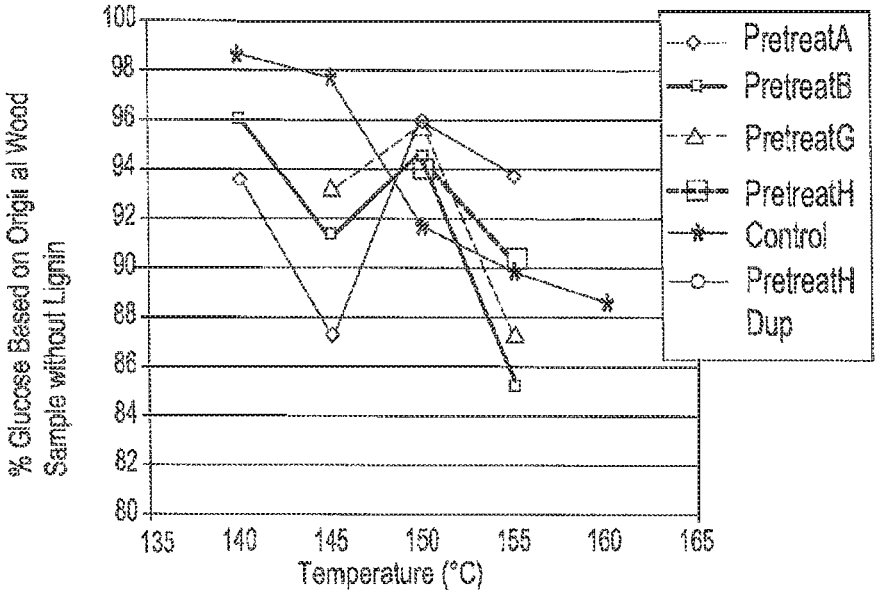
FIG. 10 is a graph showing glucose present as a function of hot water extraction temperature in Example 3.

In order for the pretreatment to be useful, it was important to ensure the fungus was not consuming a significant amount of cellulose. Cellulose is the dominant source of glucose in hardwoods, and glucose content is used to estimate cellulose losses in this study. FIG. 10 shows that the glucose content was similar for the control and pretreated chips after extraction. The results are promising, as the treatment did not lead to significant glucose losses. This could serve as an indicator that the cellulose component has been preserved. However, preservation of the glucose does riot necessarily mean that strength properties of the resulting paper have been preserved. It is possible that the cellulose chains have been weakened by internal cleavage without glucose losses.

FIG. 11 shows that maximum xylan recovery (measured as the monomer sugar xylose) was 60.5% of the original xylose in the wood. This was achieved with fungal pretreatment A at 150° C. The average recovery for all of the pretreatment trials at this temperature was 37.4% with a range from 24.6% to 60.5% based on the original xylose content in wood. All values were higher than the 23.2% recovery of the control untreated samples at 150° C. At temperatures between 140 and 150° C., the treated wood chips yielded equal or greater extraction amounts compared to control chips at temperatures 5 to 10° C. lower. The mass loss in the chip wash following the extraction was 6.4% with the pretreated samples, but only 1.3% with the control. Potentially, additional xylose could be recovered from the wash water, increasing the overall yield of the xylose.

The mass that was washed away was not collected, and therefore was calculated by difference. However, if this mass had not been washed away and the chips were left to dry with no washing, the washed away mass would have remained in the wood and gone forward in the process. These washed away materials were loosely bound to the fibers based on the simple lab washing conducted in this study. On a mill scale, these extractives could be recovered with a chip washing step and then would not remain with the wood. As the content of the extracts studied has little or negative value in pulping, the washing to recover additional xylan and remove it from the pulping stage is worth studying.

Conclusions

*C. subvermispora* pretreated wood chips allowed for the extraction of more xylan from the wood or the use of a lower extraction temperature than for control chips at a given extraction amount. Recovered extracted xylan (measured as xylose) from the pretreated chips at 150° C. ranged from 24.6% to 60.5% based on the original xylose content in wood. Hot water extraction without fungal pretreatment at the same temperature and conditions, allowed for the recovery of 23.1% of the xylose component. Future work is needed to optimize the combination temperatures and extraction times with respect to the xylan recovery. In addition, the recovery of the post-extraction chip washing liquor may yield additional xylan recovery from biomass willow chips.

The lignin remaining with the wood after water extraction was lower for the pretreated samples than for the untreated wood chips. This might well result in savings later in the process when lignin is to be removed or brightened during pulping. More work should be done to ascertain the relative effects of fungal pretreatment and pH on the lignin removal during the water extraction process. The effect of the hemicellulose extraction and the concurrent lignin modification on the subsequent pulping process is yet to be explored.

The glucose component in the extracted wood chips did not change between pretreated and untreated chips. This indicates that the cellulose content has not been measurably affected by the pretreatment. However, this does not necessarily mean that strength properties of the resulting paper have been preserved and it yet to be determined. Past results have shown biopulping preserved the strength properties of the chips, but this should be explored further for this particular post-biotreatment extraction procedure.

EXAMPLE 4

A typical bleaching sequence for hardwood kraft pulps is $OD_0EopD_1$ or $OD_0EopD_1P$. Softwood kraft pulps normally require more chlorine dioxide ($ClO_2$) and a typical sequence is $OD_0EopD_1ED_2$. Alkaline $O_2$ is represented by O while $D_0$=$ClO_2$ delignificaiton at end pH 2-3; E=alkaline extraction with NaOH (Ep when hydrogen peroxide is added and Eop when $O_2$ and $H_2O_2$ are added for incremental delignificaion; $D_1$=$ClO_2$ brightening at end pH 3.5-4.5; $D_2$=$ClO_2$ brightening at end pH 4-6; and P=$H_2O_2$ brightening at ph>10.

The addition of $O_2$ addition to D stages has not been investigated. It is understood that carbon-centered free radicals are generated in D or D/$P_M$ bleaching ($P_M$=hydrogen peroxide bleaching catalyzed by sodium molybdate). The $P_M$ is added to a D stage without any change in its treatment conditions.

Since $O_2$ is cheaper than $ClO_2$ it would be economically beneficial if these carbon-centered free radicals are coupled with $O_2$ instead of the more expensive $ClO_2$. Coupling with $O_2$ is shown in equation [1] below. The peroxy radical formed can abstract a hydrogen atom from reactive lignin sites thus affording more delignification (equation 2)

$$RH_2C.+O_2 \rightarrow RH_2COO. \quad [1]$$

$$RH_2COO.+LH \rightarrow L.+RH_2COOH \quad [2]$$

The peroxide generated in equation [2] could further degrade or brighten the lignin. Unfortunately, the peroxide could also be catalytically decomposed by transition metals (Eqn. [3) to form the hydroxyl radical (.OH) that would depolymerized the carbohydrate fraction.

$$RH_2COOH+M^{n+} \rightarrow RH_2CO^-+.OH+M^{(n+1)+} \quad [3]$$

Pursuant to these principles, a large batch of hardwood kraft pulp was assembled to investigate $O_2$ addition to D stages. All of the available pulps that were already delignified with alkaline $O_2$ were collected. These pulps were dispersed in a large plastic vessel at ~5% consistency. The pulp mixture was then treated with 1.12% $KHSO_5$ (0.25% equiv. $H_2O_2$) at room temperature overnight. The pH the following morning was ~4.7. The pulp was then treated with 0.2% $Na_5DTPA$ with $Na_2CO_3$ being used to achieve pH-6. The pulp was dewatered to ~25% consistency the following day. This pulp was the starting material for bleaching under $D_1$ stage conditions. It had a kappa number of 8.4, a viscosity of 23.0 cP and a brightness of 62.5% Elrepho. The pulp contained 4 ppm Mn, 25 ppm Fe and 7 ppm Cu.

Most of the bleaching experiments were performed in duplicate and never were duplicate trials performed on the same day. The first results are outlined in trial numbers 1a-2b) in Table 9. All of the chemistry that was projected was observed in the data. Oxygen addition resulted in a higher brightness and a lower viscosity (used to estimate the degree of polymerization (DP) of the cellulose). Although the brightness differences caused by $O_2$ addition to a $D_1$ stage were quite significant $O_2$ addition to D/$P_M$ bleaching was investigated as confirmation. Those results are summarized in trial numbers 3a to 4b (Table 9). It can be seen that $O_2$ addition resulted in an ~1.5 point brightness increase.

Experimentation was conducted to address the lower viscosity associated with $O_2$ addition. It is known that magnesium cations improve viscosity and increases brightness in alkaline $O_2$ delignification. One of the most credible explanations of this phenomenon is that Mg cations disrupt the free radical propagation mechanism by forming complexes with superoxide anions (.$OO^-$). When NaOH was replaced by $Mg(OH)_2$ there were significant improvements in both brightness and viscosity (trials 5 and 6). On a weight basis, $Mg(OH)_2$ presently costs only one-half that of NaOH. Therefore, by replacing NaOH with $Mg(OH)_2$ and adding $O_2$ one can achieve ~3.5 points higher brightness and lower bleaching cost. The cost of $O_2$ addition would be negligible.

Next, $O_2$ addition under $D_0$ condition with a 13 kappa number unbleached hardwood pulp was investigated. There was a significant increase in brightness after $D_0Ep$ but AOX in the $D_0$ effluent was only decreased by 4.5% (Table 10).

TABLE 9

Simultaneous Bleaching with $ClO_2$ and $O_2$

| Trial # | % $ClO_2$ | % $H_2O_2$ | % NaOH | $O_2$ Addition[1] | End pH | Bright. % Elrepho | Kappa # | Viscosity cP |
|---|---|---|---|---|---|---|---|---|
| 1a | 1.0 | 0 | 0.5 | N | 3.5 | 77.2 | 2.7 | 20.5 |
| 1b | 1.0 | 0 | 0.5 | N | 3.4 | 76.2 | 2.7 | 19.5 |
| 2a | 1.0 | 0 | 0.5 | Y | 3.4 | 78.6 | 2.4 | 18.1 |
| 2b | 1.0 | 0 | 0.5 | Y | 3.3 | 78.0 | 2.4 | 18.0 |
| 3a | 0.6 | 0.4 | 0.3 | N | 4.5 | 72.6 | — | — |
| 3b | 0.6 | 0.4 | 0.3 | N | 4.1 | 72.8 | — | — |
| 4a | 0.6 | 0.4 | 0.3 | Y | 3.8 | 74.7 | — | — |
| 4b | 0.6 | 0.4 | 0.3 | Y | 3.8 | 73.9 | — | — |
| 5 | 1.0 | 0 | 0.36% $Mg(OH)_2$ | Y | 3.3 | 79.9 | 2.4 | 21.8 |

TABLE 9-continued

| Simultaneous Bleaching with $ClO_2$ and $O_2$ | | | | | | | | |
|---|---|---|---|---|---|---|---|---|
| Trial # | % $ClO_2$ | % $H_2O_2$ | % NaOH | $O_2$ Addition[1] | End pH | Bright. % Elrepho | Kappa # | Viscosity cP |
| 6 | 1.0 | 0 | 0.40% $Mg(OH)_2$ | Y | 3.6 | 80.4 | 2.4 | 20.5 |

[1]$O_2$ partial pressure = 0.72 MPa

TABLE 10

| Addition of Oxygen to a Stage $D_0$ | | |
|---|---|---|
| | With $N_2$ | With $O_2$ |
| Unbleached Kappa No. | 13.0[1] | 13.0[1] |
| $D_0$ Stage End pH | 3.1 | 3.2 |
| AOX in $D_0$ effluent[2] | 0.45 | 0.43 |
| Brightness after $D_0$ stage[3] | 54.2 | 58.6 |
| Brightness after Ep Stage[3] | 63.8 | 65.2 |
| Kappa No. after Ep Stage | 4.7 | 4.4 |

[1]Kraft pulp produced from a mixture of sugar maple, white birch and cottonwood (1:1:1) by Econotech Lab, British Columbia, Canada
[2]Determined by Andritz Inc., Glens Falls, NY; values in g/kg pulp or kg/ton pulp
[3]% Elrepho The next step was the investigation of a mill pulp with low kappa number after ODEop treatment. An eucalyptus kraft pulp with kappa number 2.0 and 68% Elrepho brightness was obtained. This pulp was first bleached with 0.8% $ClO_2$ and 0.30% $Mg(OH)_2$. A brightness of 87.6% was obtained but the end pH was 7.0. The experiment was repeated but the $Mg(OH)_2$ dose was decreased to 0.15%. A brightness of 87.4% and end pH 6.6 were obtained. Approximately 7 months later neither pulp had lost any brightness whatsoever as a result of thermal reversion. Both pulps were stored at 30% consistency and at room temperature (20-25° C.) in a laboratory. Eucalyptus kraft pulps generally reverted more than other wood species and sometimes this reversion can be severe. The initial and reverted brightnesses of these pulps are presented in Table 11.

TABLE 11

| Initial and Reverted Brightness of *Eucalyptus* Kraft Pulp bleached with $ClO_2/Mg(OH)_2/O_2$ | | | | | |
|---|---|---|---|---|---|
| Sample | $ClO_2$ % | $Mg(OH)_2$ % | End pH | Bleached Brightness[1] | Reverted Brightness[1] |
| 1 | 0.8 | 0.3 | 7.0 | 87.6 (Sep. 20, 2005) | 87.8 Apr. 12, 2006 |
| 2 | 0.8 | 0.15 | 6.6 | 87.4 (Sep. 21, 2005) | 87.3 Apr. 12, 2006 |

[1]% Elrepho

Finally, a large batch of a softwood kraft pulp from loblolly pine (*Pinus taeda*) was delignified by OQP to kappa number 6.8 and 59.2% ISO brightness and shipped to an independent laboratory for confirmation. The agreed up NaOH and $Mg(OH)_2$ doses were too high and an end pH of 7.2 was obtained for $ClO_2/NaOH/N_2$ while the value was 7.6 for $ClO_2/Mg(OH)_2/O_2$. The comparison was repeated by the independent laboratory with less NaOH and $Mg(OH)_2$. All the results are documented in Table 12. These results show a one point brightness improvement for $ClO_2/Mg(OH)_2/O_2$ at both ph ~7.5 and pH ~4.5. The independent laboratory performed accelerated thermal reversion for the ph ~4.5 samples and saw no improvement for $ClO_2/Mg(OH)_2/O^2$. However, the pH ~7.5 samples were returned and the brightness determination showed that the $NaOH/N_2$ sample was reverting at a much faster rate than the $ClO_2/Mg(OH)_2/O_2$ sample. The independent laboratory results was consistent with those in Table 11 that show no decrease in brightening efficiency as the end pH for $ClO_2/Mg(OH)_2/O_2$ is increased above the reported optimum of ~4.0. Therefore, by using $ClO_2/Mg(OH)_2/O_2$ at pH≥7 excellent bleaching is obtained and reversion is minimal.

TABLE 12

| Oxygen and $Mg(OH)_2$ Addition to $D_1$ Stage bleaching of Loblolly Pine Kraft Pulp with kappa number 6.8 and 59.2% ISO Brightness | | | | |
|---|---|---|---|---|
| Kappa Number | 6.8 | | | |
| Viscosity (mPa · s) | 9.8 | | | |
| Brightness, % ISO | 59.2 | | | |
| D Stage: 70° C. 120 min., 10% cons. | Control | | Control | |
| $ClO_2$, %[1] | 1.0 | 1.0 | 1.0 | 1.0 |
| NaOH, %[1] | 0.5 | — | 0.2 | — |
| $Mg(OH)_2$, %[1] | — | 0.43 | — | 0.25 |
| Oxygen pressure, psi | — | 80 | — | 80 |
| Final pH | 7.2 | 7.6 | 4.2 | 4.7 |
| $ClO_2$ Consumed, % | 0.77 | 0.90 | 1.0 | 1.0 |
| ISO Brightness, % | 79.4 | 80.3 | 79.3 | 80.3 |
| Reverted Brightness units 4 hr, @ 105 C. | ~2.0 | ~0 | 2.2 | 2.1 |

[1]% on pulp

EXAMPLE 5

Raw Material

*Acer saccharum* (Sugar Maple) wood logs obtained from ESF Forest Properties were debarked and chipped in a Carthage chipper located in the Paper Science and Engineering department at SUNY-ESF to a size normally used in industry (2.5×2.0×0.5 cm). The chips were air dried to moisture content of 10-12% and stored in a single lot for use in all the experimental work in order to avoid differences in composition. One part of these sugar maple chips was ground in a Wiley Mill to a particle size passing a 30-mesh screen. The wood meal obtained was stored separately in a single lot to be used in the autohydrolysis experiments on wood meal.

Analysis of wood

Sugars analysis of both the raw wood and the extracted wood samples was performed by $^1$H-NMR spectroscopy with the Bruker AVANCE 600 MHz NMR system using a method described by Copur et al. 2002. Extracted wood chips were ground to a particle size <30-mesh screen using a Wiley Mill. For NMR analysis, 0.20 ml of 72% $H_2SO_4$ was added to 0.040 g of OD (oven dried) milled wood mass. After stirring, the dispersion was allowed to digest at 40° C. for 60 min. in a water bath with additional stirring every 15 minutes. After this digestion, 5.4 ml of $D_2O$ (NMR solvent)

was added to the dispersion, which was then autoclaved at 121° C. for 60 min. After cooling 0.42 ml of 96% $H_2SO_4$ was added which was followed by the addition of TMA (trimethyl amine), an internal standard. Klason lignin and acid soluble lignin were determined by standard TAPPI methods, T 222 om-88 and UM 250, respectively.

Hydrothermal Treatment of Wood Samples

To obtain the desired liquor to solid ratio (LSR) in the autohydrolysis experiments, wood chips or wood meal were mixed with water and the moisture content of the raw material (sugar maple wood chips or wood meal) was considered as water in the material balances. The wood meal was treated in 100-nil stainless steel reaction bombs, which were heated to the desired temperature by placing them in a Techne (Tempunit® TU-16) oil bath, that had been preheated to the desired temperature, and controlled within ±1° C. The reaction bombs were filled up to 75% of the total volume to provide space for liquid expansion at the reaction temperature. Wood chips were treated in a 4-liter M/K digester equipped with a centrifugal pump for liquor circulation and a PID temperature controller. The time to heat wood chips to the desired temperature in M/K digester was about 25-30 minutes. For wood meal, since stainless steel is a good conductor of heat, the time to reach the reaction temperature in the reaction bomb was assumed to be 5 minutes. Since a portion of the reaction material may have reacted during the heating period, only data corresponding to the isothermal reaction condition were used in the data analysis. For both wood meal and wood chips, time zero was taken to be the beginning of the isothermal stage. For wood meal the reaction was terminated by quenching the reaction bombs in cold water and for wood chips by switching off the M/K digester and discharging the liquor through a heat exchanger.

Analysis of Hydrolyzate from Hydrothermal Treatment

For quantification of sugars and sugar degraded products i.e. furfural and HMF in the hydrolyzate obtained from the autohydrolysis experiments, analysis was performed on two aliquots. The first aliquot was used directly for the determination of furfural and HMF with $^1$H-NMR, whereas for determining sugars, 0.24 ml of 96% $H_2SO_4$ was added to 1.0 g of the second aliquot of the liquid hydrolyzate which was then heated at 80° C. for 60 min in a water bath. The digested sample was tested for quantification of the sugars with $^1$H-NMR. In both aliquots, TMA was used as an internal standard for the reference peak.

Treatment of Wood by Severity Analysis

To evaluate the hemicellulose hydrolysis process, the severity approach was utilized. The severity analysis is based on the assumption that the overall kinetics follow a first-order concentration dependence and the rate constants have the Arrhenius-type dependence on temperature. However, in this approach time and temperature are combined into a single factor called the severity factor (Overend and Chornet, 1987). Due to its simplified form and more general application (on different raw materials) we have interpreted our data using the severity analysis approach. The model for hemicellulose hydrolysis as presented by Garrote et al., 2002 is given by $$C_A=(1-\alpha)\times C_{A0}+\alpha\times C_{A0}\times\exp(-k_r\times R_o) \quad (1)$$

where $C_A$ is the concentration of the reactant at time, t, $C_{A0}$ that at time, t=0, $\alpha$ is the weight fraction of susceptible xylan in the raw material ($0<\alpha<1$), $k_r$ is the kinetic constant measured at a reference temperature $T_r$ and $R_o$ is the severity factor which is defined as $$R_o = \int_0^{t(min)} \exp\left(\frac{T-T_r}{\omega}\right)dt \quad (2)$$

where T is the absolute temperature while $\omega$ is a function of the reference temperature $T_r$ and activation energy, $E_a$ and is defined as $$\omega = \frac{R\times T_r^2}{E_a} \quad (3)$$

Since time and temperature are combined in a single parameter i.e. the severity factor, the main advantage of severity analysis is that it enables one to compare the severity of the hydrolysis treatment for a wide range of operation conditions (time and temperature) represented by a single reaction ordinate ($R_o$). To study the optimum conditions for xylose yield in the hydrolyzate, the experiments were conducted for different times and temperature conditions in order to vary the single variable ($R_o$) from a region of low severity (log $R_o$=2) where fractionation or hemicellulose hydrolysis begins to the region of high severity (log $R_o$>3.0) where depolymerization, condensation and degradation reactions start to occur (Heitz et al., 1991; Zhuang and Vidal, 1996). Equation (2) was used to calculate the severity factor at the reference temperature $T_r$=145° C. According to the previous studies (Belkacemi et al., 1991; Abatzoglou et al., 1992; Garrote et al., 2002) the selection of the reference temperature $T_r$ is not influential for data analysis and most of the authors (Overend and Chornet, 1987; Heitz et al., 1991; Zhuang and Vidal, 1996) have chosen 145° C., as the reference temperature. We also selected $T_r$=145° C. in our study because at this temperature we observed minimum or negligible hemicellolose solubilization at short reaction times. The relation between the treatment severity and experimental variables (time and temperature) for the experiments conducted in this study is shown in Table 13.

TABLE 13

Experimental conditions of time and temperature and their relation to the severity factor (see Table 3 for values of $E_a$ used to calculate $\omega$)

| Experimental variables | | Severity factor ($R_o$) |
|---|---|---|
| Temperature (° C.) | Time (min.) | log ($R_o$) ($R_o$ is in min.) |
| 160 | 120 | 2.6 |
| 160 | 180 | 2.8 |
| 160 | 240 | 2.9 |
| 175 | 90 | 3.0 |
| 175 | 120 | 3.1 |

Material Balances

The material balance is important for determining the conversion efficiency of a chemical process and it also provides the appropriateness of the experimental conditions applied in the process. The results of the material balances for the selected experiments that cover the range of treatment severity are given in Table 14.

TABLE 14

Material balances in the experiments conducted at different treatment severities

| log ($R_o$) ($R_o$ is in min.) | Yield of water insoluble fraction (wt %) | Yield of water-soluble fraction (wt %) | Material losses* (wt %) |
|---|---|---|---|
| 2.6 | 79.0 | 16.8 | 4.2 |
| 2.8 | 76.1 | 19.9 | 4.0 |
| 2.9 | 76.2 | 19.2 | 4.6 |
| 3.0 | 76.9 | 18.1 | 5.0 |
| 3.1 | 75.1 | 16.2 | 8.6 |

*by difference

In autohydrolysis of sugar maple wood, the yield of the water insoluble fraction decreased with the increased treatment severity (Table 14). 24.9% of the initial wood mass could be solubilized at the reaction severity of log $R_o$=3.1. The yield of water soluble fraction also increased with increasing treatment severity and after reaching a maximum recovery of 19.9% of initial wood mass in the hydrolyzate at log $R_o$=2.8, it decreased. The possible explanation of this phenomenon is that at higher treatment severities, acidic conditions prevail in the solution (at log $R_o$=3.1, pH=2.8) which lead to various condensation and degradation reactions via which degraded products like furfural, HMF, levulinic acid, formic acid and other volatile or unidentified compounds are formed (Sjostorm, 1993). This is also evident from the material balance closure presented in Table 14, which shows that as the treatment severity increased, the amount of lost mass also increased.

Severity Analysis of Hemicellulose Solubilization and Deacetylation

The severity approach has been used to fit the residual xylan data by various authors for different raw materials under various time and temperature conditions data obtained for isothermal and non-isothermal temperature conditions and different liquor to solids ratios). In this work, data for hemicellulose solubilization obtained during the isothermal conditions for sugar maple wood are considered. $C_A$ is defined as the grams of unconverted substance (xylan or acetyl groups) per 100 grams of the initial substance. Equation (1) was fitted to the experimental data obtained in this work and the values of the regression parameters $\alpha$, $k_r$, and $E_a$ were calculated by minimization of the sum of the squares of the deviation between the variable $C_A/C_{A0}$ (see eq. (1)) and its experimental value. For optimization, the SOLVER function of MS-EXCEL was used. The fitting parameters obtained in this work are compared with the parameters obtained by various authors, as given by Garrote et al., 2002, and are shown in Tables 15 and 16 for xylan solubilization and deacetylation, respectively. From Tables 15 and 16 it can be observed that $\alpha$ (weight fraction of susceptible xylan) obtained in this work for the wood meal data is in the range ($\alpha$=0.83-0.89) previously reported in the literature. It is important to note that the value of $\alpha$ for wood chips is lower compared to that for wood meal. This is explained by the reason that due to the larger particle size of wood chips there is diffusion limitation and at the comparable treatment severity less amount of xylan solubilizes or in other words wood chips have less weight fraction of susceptible xylan available than wood meal that can be solubilized at the same level of treatment severity.

The activation energies, $E_a$ determined for both xylan solubilization and deacetylation for wood chips are higher compared to the respective activation energies for wood meal (see Tables 15 and 16). The difference in the activation energy for wood chips and wood meal can be justified by offering the same explanation of diffusion limitation in wood chips. The values of activation energies, $E_a$ determined for both xylan solubilization and deacetylation of wood chips and wood meal in this study are well within the range ($E_a$=112-137 kJ $mol^{-1}$) of activation energies determined previously for various raw materials (Tables 15 and 16). The comparison of experimental results and theoretical predictions are presented in FIGS. 12 and 13 for xylan solubilization and deacetylation, respectively for both wood meal and wood chips.

TABLE 15

Values of regression parameters obtained for xylan solubilization

| Raw material | $\alpha$ (dimensionless) | $k_r \cdot 10^3$ ($min^{-1}$) | $E_a$ (kJ $mol^{-1}$) | Source of data |
|---|---|---|---|---|
| Sugar Maple* | 0.780 | 7.00 | 122 | this work |
| Sugar Maple$^{\Psi}$ | 0.880 | 4.00 | 112 | this work |
| *Eucalyptus globulus* | 0.857 | 6.44 | 124 | Garrote et al. 2002 [9] |
| *Populus tremuloides* | 0.826 | 2.25 | 137 | [9] |
| Birch | 0.889 | 5.28 | 135 | [9] |
| Corncobs | 0.882 | 5.43 | 115 | [9] |

*wood chips,
$^{\Psi}$wood meal

TABLE 16

Values of regression parameters obtained for acetyl groups solubilization

| Raw material | $\alpha$ (dimensionless) | $k_r \cdot 10^3$ ($min^{-1}$) | $E_a$ (kJ $mol^{-1}$) | Source of data |
|---|---|---|---|---|
| Sugar Maple* | 0.750 | 3.00 | 115 | this work |
| Sugar Maple$^{\Psi}$ | 0.880 | 3.00 | 108 | this work |
| Hardwoods | 0.879 | 6.02 | 121 | Garrote et al. 2002 |
| Corncobs | 0.899 | 6.05 | 111 | |

*wood chips,
$^{\Psi}$wood meal

Figure 12:
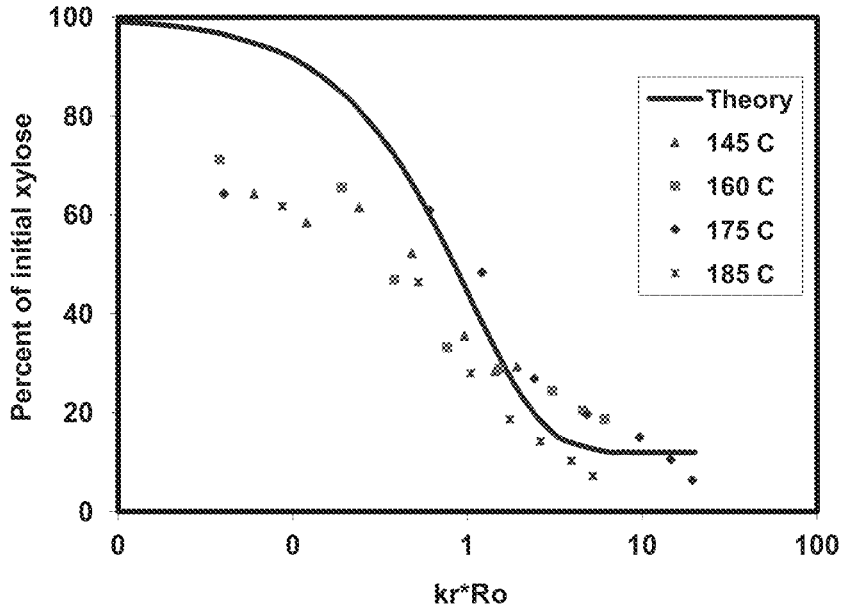
FIG. 12 is a plot of xylan solubilization for sugar maple wood meal (i) and wood chips (ii) in Example 5.
Figure 12:
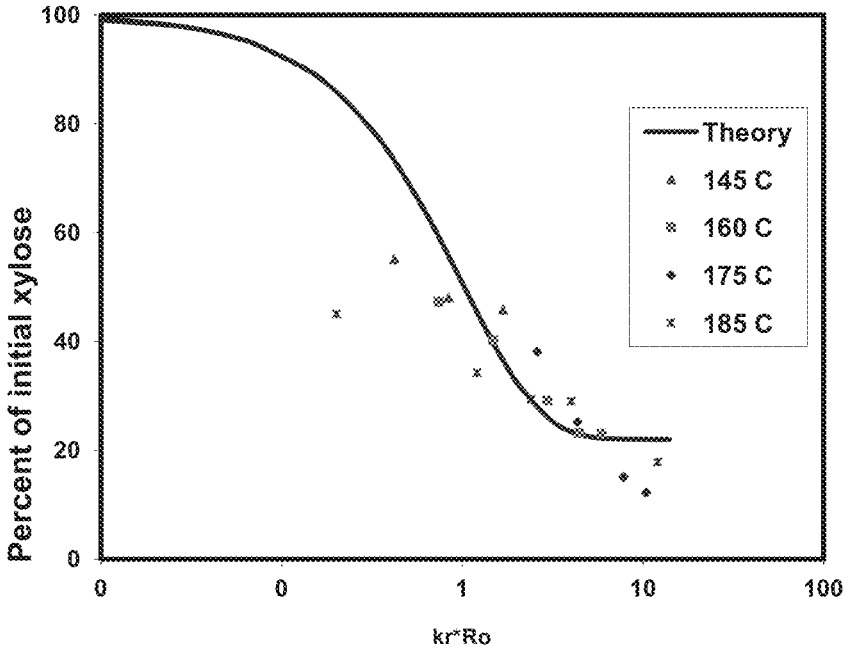
Figure 13:
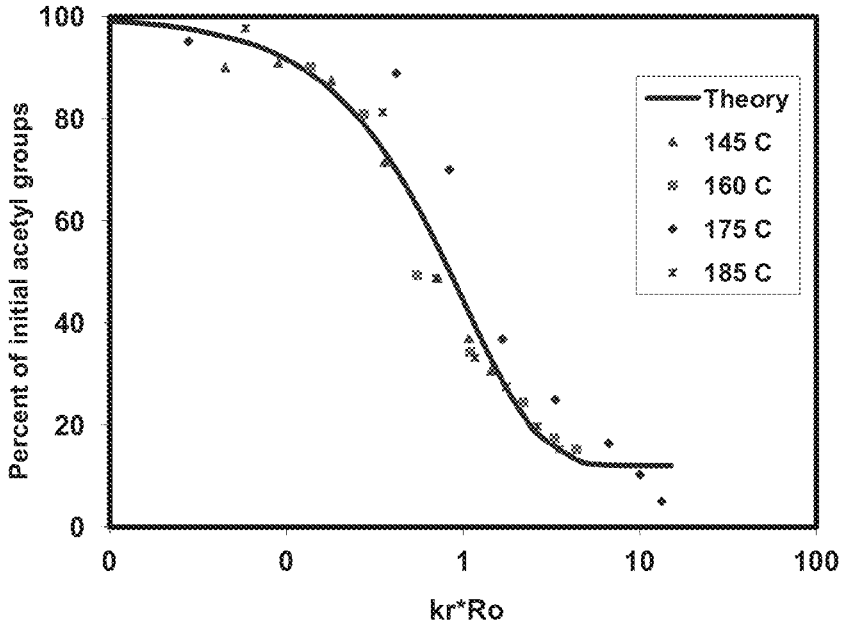
FIG. 13 is a plot xylan deacetylation for sugar maple wood meal (i) and wood chips (ii) in Example 5.
Figure 13:
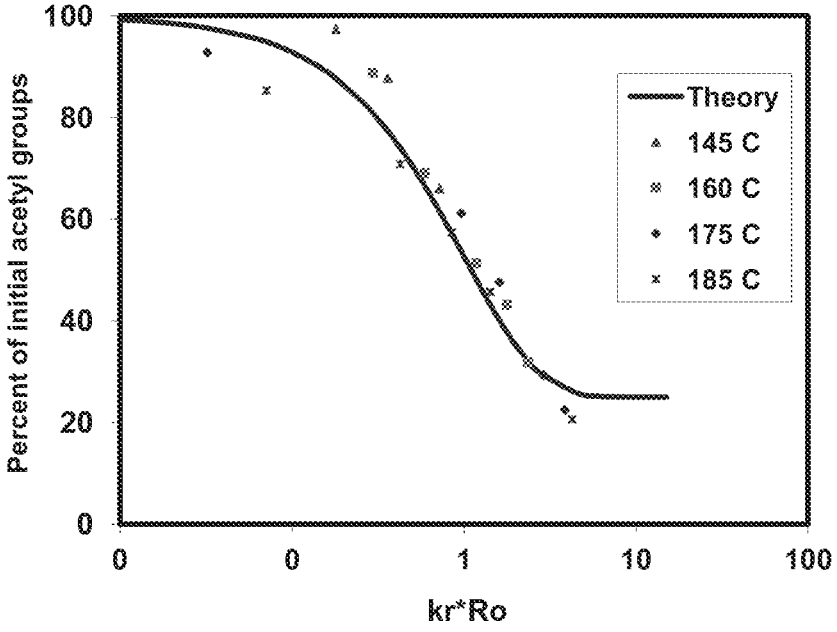

From FIGS. 12 and 13 it can be seen that as the treatment severity increases the extent of xylan solubilization or deacetylation increases for both wood chips and wood meal and reaches a constant residual amount of xylan in both wood chips and wood meal which is difficult to hydrolyse. This residual xylan, which has been reported in earlier studies (Conner, 1984; Conner and Lorenz, 1986) as less-reactive xylan is considered to be in deep association with cellulose and lignin and is difficult to hydrolyse with hydrothermal treatment without affecting the cellulose and lignin. From FIGS. 12 and 13 it can be observed that the experimental data is in fair agreement with the model [eq. (1)]. As can be seen from FIGS. 12 and 13 we did not have much data in the lower range of the treatment severity since the experiments in this study were conducted in the severity range of 2.0<=log $R_o$<=3.1. More experimental work is expected to be conducted at low treatment severities.

Yields of Acetyl Groups, Xylose and Furfural in the Hydrolyzate

Figure 14:
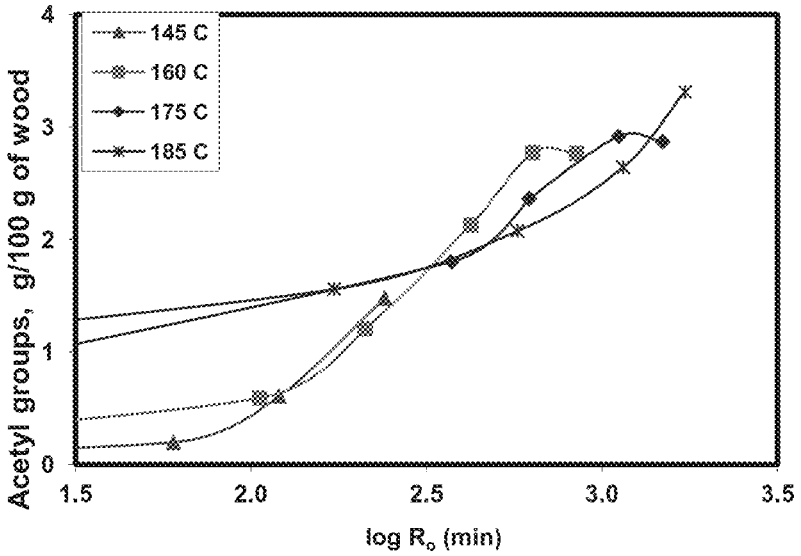
FIG. 14 is a plot showing the concentration of acetyl groups in the hydrolyzate with increasing severity in Example 5.
Figure 15:
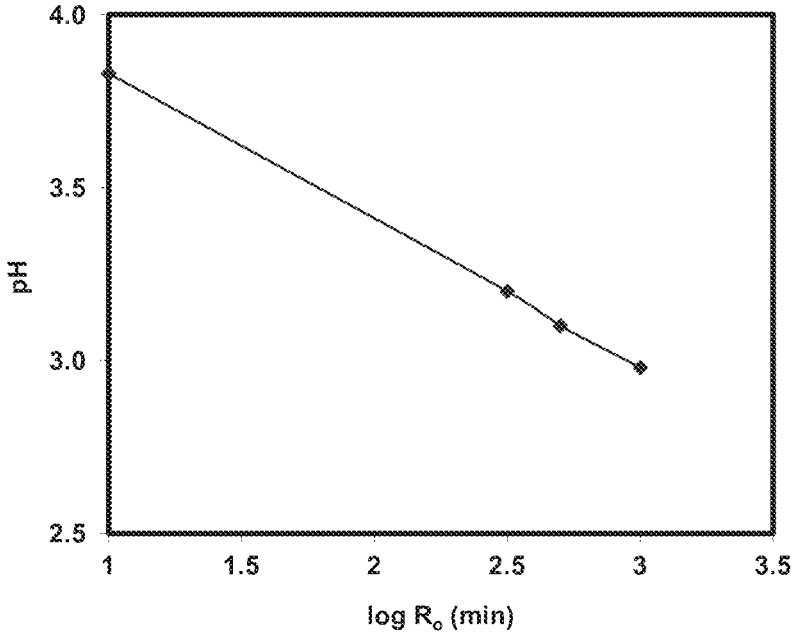
FIG. 15 is a plot showing pH of hydrolyzate as a function of treatment severity in Example 5.

From FIG. 12 it can be concluded that as the extent of treatment severity increases, xylan solubilization also increases and about 90% of the initial xylan hydrolysis is achieved at a treatment severity of log $R_o$=3.1. It has been reported (Heitz el al., 1991) that the solubilized xylan exists initially as xylooligorners and xylose in the extracted hydrolyzate. As soon as free acetyl groups become available (due to the cleavage of acetyl groups directly from the xylan chain or from xylooligomers present in the hydrolyzate), it leads to the formation of acetic acid (Springer and Harris, 1982; Heitz et al., 1991). The dissociation of the acetic acid thus formed results in an increased concentration of hydronium ions, which further catalyzes the autohydrolysis reaction and results in a decrease in the xylooligomers concentration and an increase in the xylose concentration in the hydrolyzate. The concentration of the acetyl groups in the hydrolyzate with the increased severity is shown in FIG. 14. It is interesting to note that at severity of log $R_o$=3.0, the concentration of acetyl groups in the hydrolyzate is about 3 g/100 g of initial wood which corresponds to 80% of the acetyl groups initially present in the wood. An increase in the hydronium ions or a drop in pH with the increased treatment severity is shown in FIG. 15.

Figure 16:
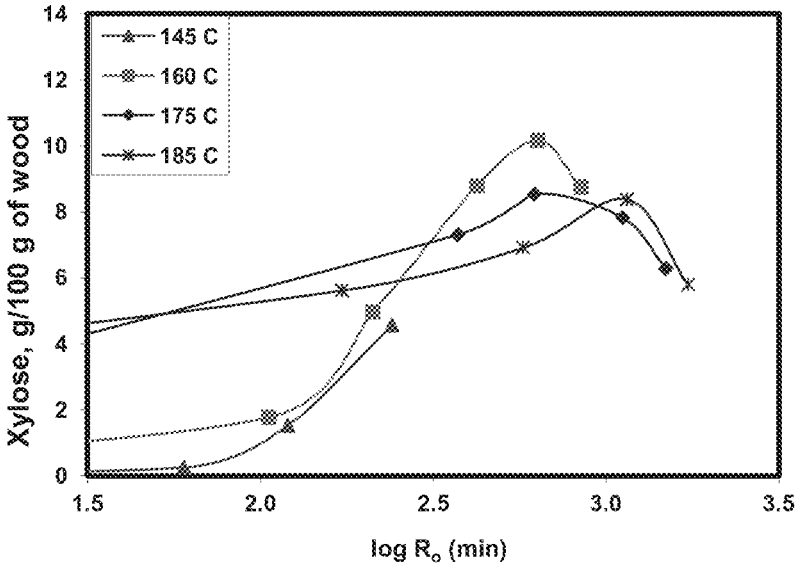
FIG. 16 is a plot showing xylose yield as a function of treatment severity in Example 5.
Figure 17:
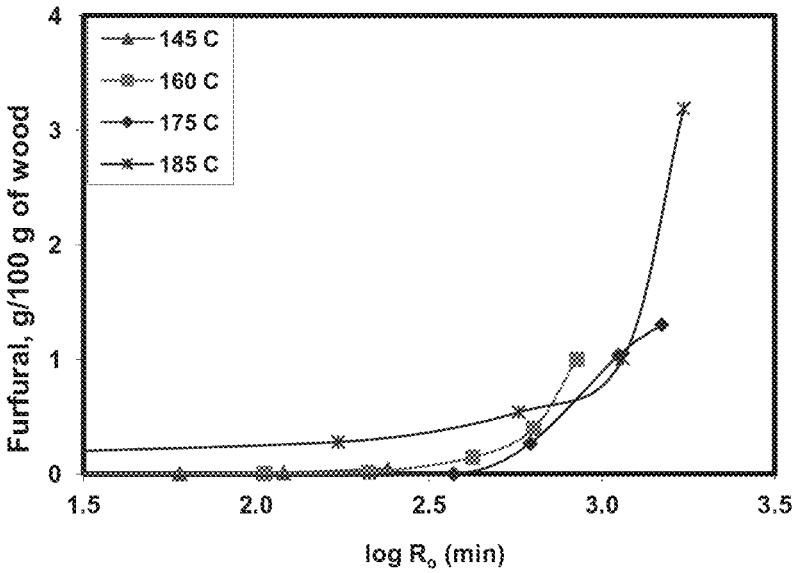
FIG. 17 is a plot showing the formation of furfural as a function of treatment severity in Example 5.

The relationship between the concentration of xylose and treatment severity is shown in FIG. 16. From FIG. 16 it can be noticed that xylose concentration increases initially and the maximum amount of xylose recovery of 65% as xylose, based on total initial xylan in wood, in the hydrolyzate is obtained at log $R_o$=2.8 which corresponds to a 3-hr treatment of sugar maple chips at 160° C. (Table 13). The maximum amount of xylose recovered in the hydrolyzate in our study is consistent with the range of maximum pentosans (xylose in our study) recovery of 65-70% that has been reported in earlier studies (Zhuang and Vidal, 1996). The reason for the maximum xylose recovery in the hydrolyzate to be limited to 65-70% is due to competition between two simultaneous reactions taking place in the process: (i) xylan solubilisation and (ii) degradation of the solubilized xylan to furfural and other degradation products (Zhuang and. Vidal, 1996). It is important to note in FIG. 16 that at severities beyond log $R_o$>2.8, xylose concentration in the hydrolyzate starts decreasing owing to the formation of furfural and other degradation products of xylose. FIG. 17 shows the formation of furfural with the increased treatment severity. Up to a severity of log $R_o$=2.5, no considerable formation of furfural is observed but as the treatment severity is increased above log $R_o$>2.8, the concentration of furfural reaches to a level of 1 g/100 g of initial wood.

The above embodiments and examples are given to illustrate the scope and spirit of the present application. These embodiments and examples will make apparent, to those skilled in the art, other embodiments and examples. Those other embodiments and examples are within the contemplation of the present invention. Therefore, the present invention should be limited only by the appended claims.

What is claimed is:

1. A process of pulping lignocellulosic materials comprising:

(a) contacting a charge of a lignocellulosic material with water, the water and charge of lignocellulosic material maintained at a temperature in the range of between about 130° C. and about 200° C. and lowering the pH to between about 3 and about 6.9 by producing acetic acid from the reaction of the water and lignocellulosic material for a period in the range of between about 15 minutes and about 240 minutes, wherein an aqueous extract and extracted lignocellulosic materials are obtained;

(b) pulping said extracted lignocellulosic materials with a mixture of a hydroxide and an anthraquinone (AQ) wherein individual fibers and fiber bundles are produced; and (c) apply $O_2$ delignification to the individual fibers and fiber bundles to form a delignified mass, wherein the delignified mass has an $O_2$ kappa value of 9.0 or less after about 90 minutes.

2. The process of claim 1, wherein the hydroxide is selected from the group consisting of sodium hydroxide, potassium hydroxide and mixtures thereof.

3. The process of claim 1, wherein the AQ is a sodium anthraquinone-2-sulfonate (SAQ).

4. The process of claim 1, wherein the AQ is a 2-methylanthraquinone (MAQ).

5. The process of claim 1, wherein the concentration of the AQ in the mixture is 0.05-0.1%.

* * * * *